US008738373B2

(12) United States Patent
Otani et al.

(10) Patent No.: US 8,738,373 B2
(45) Date of Patent: May 27, 2014

(54) FRAME SIGNAL CORRECTING METHOD AND APPARATUS WITHOUT DISTORTION

(75) Inventors: Takeshi Otani, Kawasaki (JP); Masanao Suzuki, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 1719 days.

(21) Appl. No.: 11/637,809

(22) Filed: Dec. 13, 2006

(65) Prior Publication Data

US 2008/0059162 A1 Mar. 6, 2008

(30) Foreign Application Priority Data

Aug. 30, 2006 (JP) ..... 2006-233763

(51) Int. Cl.
*G10L 21/02* (2013.01)
*G10L 21/00* (2013.01)

(52) U.S. Cl.
USPC ..... 704/226; 704/228

(58) Field of Classification Search
CPC ..... H04B 1/10; H04B 14/00–14/06; H04L 1/00–1/24; G10L 19/00–19/265; G10L 21/0324–21/0364
USPC ..... 704/200–218, 224–230, 246–250, 258, 704/268, 278, E19.001–E19.049, 704/E21.001–E21.02, E11.001–E11.007; 381/71.1–71.14, 73.1, 94.1–94.9, 381/104–109
See application file for complete search history.

(56) References Cited

U.S. PATENT DOCUMENTS 5,012,519 A * 4/1991 Adlersberg et al. ..... 704/226
5,133,013 A * 7/1992 Munday ..... 704/226
5,142,582 A * 8/1992 Asakawa et al. ..... 704/228
5,142,584 A * 8/1992 Ozawa ..... 704/223
5,179,626 A * 1/1993 Thomson ..... 704/200
5,506,910 A * 4/1996 Miller et al. ..... 381/103
5,548,680 A * 8/1996 Cellario ..... 704/219
5,550,924 A * 8/1996 Helf et al. ..... 381/94.3
5,583,961 A * 12/1996 Pawlewski et al. ..... 704/241
5,668,925 A * 9/1997 Rothweiler et al. ..... 704/220

(Continued)

FOREIGN PATENT DOCUMENTS

GB 2 371 193 A 7/2002
JP 4259962 9/1992

(Continued)

OTHER PUBLICATIONS

Lyons, Richard G. "Understanding Digital Signal Processing", 2nd Edition. Chapter 3, Section 1, "Understanding the DFT Equation." Prentice Hall, 2004.*

(Continued)

*Primary Examiner* — Pierre-Louis Desir
*Assistant Examiner* — David Kovacek
(74) *Attorney, Agent, or Firm* — Smith, Gambrell & Russell, LLP

(57) ABSTRACT

In a signal processing method and apparatus, a predetermined correcting signal having a same frame length as a second frame signal in which predetermined processing is performed to a frequency spectrum of a first frame signal of a frame length to which a predetermined window function is performed and is converted into a time domain is adjusted so that amplitudes of both ends of the correcting signal become equal to amplitudes of both or one of frame ends of the second frame signal, and a corrected frame signal is obtained by subtracting an adjusted correcting signal from the second frame signal.

12 Claims, 18 Drawing Sheets

(56) References Cited

U.S. PATENT DOCUMENTS

| | | | | |
|---|---|---|---|---|
| 5,680,393 | A * | 10/1997 | Bourmeyster et al. | 370/286 |
| 5,687,285 | A | 11/1997 | Katayanagi et al. | |
| 5,812,970 | A * | 9/1998 | Chan et al. | 704/226 |
| 5,819,212 | A * | 10/1998 | Matsumoto et al. | 704/219 |
| 5,828,996 | A * | 10/1998 | Iijima et al. | 704/220 |
| 5,862,518 | A * | 1/1999 | Nomura et al. | 704/214 |
| 5,890,118 | A | 3/1999 | Kagoshima et al. | |
| 6,011,846 | A * | 1/2000 | Rabipour et al. | 379/406.06 |
| 6,018,707 | A * | 1/2000 | Nishiguchi et al. | 704/222 |
| 6,044,341 | A * | 3/2000 | Takahashi | 704/226 |
| 6,070,137 | A * | 5/2000 | Bloebaum et al. | 704/227 |
| 6,167,375 | A * | 12/2000 | Miseki et al. | 704/229 |
| 6,205,421 | B1 * | 3/2001 | Morii | 704/226 |
| 6,405,163 | B1 * | 6/2002 | Laroche | 704/205 |
| 6,415,253 | B1 * | 7/2002 | Johnson | 704/210 |
| 6,456,968 | B1 * | 9/2002 | Taniguchi et al. | 704/229 |
| 6,526,385 | B1 * | 2/2003 | Kobayashi et al. | 704/504 |
| 6,775,654 | B1 * | 8/2004 | Yokoyama et al. | 704/500 |
| 6,778,954 | B1 * | 8/2004 | Kim et al. | 704/226 |
| 6,810,273 | B1 * | 10/2004 | Mattila et al. | 455/570 |
| 6,931,292 | B1 * | 8/2005 | Brumitt et al. | 700/94 |
| 7,016,841 | B2 * | 3/2006 | Kenmochi et al. | 704/258 |
| 7,200,561 | B2 * | 4/2007 | Moriya et al. | 704/500 |
| 7,333,929 | B1 * | 2/2008 | Chmounk et al. | 704/200 |
| 7,454,332 | B2 * | 11/2008 | Koishida et al. | 704/227 |
| 7,596,495 | B2 * | 9/2009 | Kazama et al. | 704/226 |
| 7,630,889 | B2 * | 12/2009 | Murashima | 704/230 |
| 7,979,271 | B2 * | 7/2011 | Bessette | 704/219 |
| 8,233,636 | B2 * | 7/2012 | Sugiyama et al. | 381/94.1 |
| 8,270,633 | B2 * | 9/2012 | Isaka | 381/94.2 |
| 2002/0156624 | A1 * | 10/2002 | Gigi | 704/226 |
| 2003/0009336 | A1 * | 1/2003 | Kenmochi et al. | 704/258 |
| 2003/0033152 | A1 * | 2/2003 | Cameron | 704/275 |
| 2003/0046064 | A1 * | 3/2003 | Moriya et al. | 704/201 |
| 2003/0065508 | A1 * | 4/2003 | Tsuchinaga et al. | 704/215 |
| 2003/0112265 | A1 * | 6/2003 | Zhang | 345/723 |
| 2003/0128851 | A1 * | 7/2003 | Furuta | 381/94.2 |
| 2004/0049383 | A1 * | 3/2004 | Kato et al. | 704/226 |
| 2004/0064307 | A1 * | 4/2004 | Scalart et al. | 704/205 |
| 2004/0102967 | A1 * | 5/2004 | Furuta et al. | 704/226 |
| 2005/0058301 | A1 * | 3/2005 | Brown | 381/94.2 |
| 2005/0131680 | A1 * | 6/2005 | Chazan et al. | 704/205 |
| 2005/0143988 | A1 * | 6/2005 | Endo et al. | 704/226 |
| 2005/0154584 | A1 * | 7/2005 | Jelinek et al. | 704/219 |
| 2005/0165608 | A1 * | 7/2005 | Suzuki et al. | 704/261 |
| 2005/0228660 | A1 * | 10/2005 | Schweng | 704/226 |
| 2006/0004567 | A1 * | 1/2006 | Russell | 704/209 |
| 2006/0025992 | A1 * | 2/2006 | Oh | 704/226 |
| 2006/0036435 | A1 * | 2/2006 | Kovesi et al. | 704/229 |
| 2006/0053003 | A1 * | 3/2006 | Suzuki et al. | 704/216 |
| 2006/0217980 | A1 * | 9/2006 | Murashima | 704/258 |
| 2006/0282262 | A1 * | 12/2006 | Vos et al. | 704/219 |
| 2007/0025564 | A1 * | 2/2007 | Hiekata et al. | 381/94.2 |
| 2008/0033726 | A1 * | 2/2008 | Kudoh | 704/268 |
| 2008/0059162 | A1 * | 3/2008 | Otani et al. | 704/226 |
| 2008/0089438 | A1 * | 4/2008 | Harada et al. | 375/296 |
| 2013/0077802 | A1 * | 3/2013 | Sugiyama et al. | 381/94.1 |

FOREIGN PATENT DOCUMENTS

| | | |
|---|---|---|
| JP | 7193548 | 7/1995 |
| JP | 8254993 | 10/1996 |
| JP | 9503590 | 4/1997 |
| JP | 2000-252891 | 9/2000 |
| JP | 2000252891 | 9/2000 |
| JP | 3626492 | 3/2005 |

OTHER PUBLICATIONS

Kato, M. et al., "A Wideband Noise Suppressor for the AMR Wideband Speech CODEC", IEEE Workshop Proceedings, Speech Coding, XP010647245, Oct. 6, 2002, pp. 156-158.

Communication dated Aug. 13, 2008; Extended European Search Report in the corresponding European Patent Application No. 06256371.3-2225.

Japanese Notification of Reason for Refusal dated May 31, 2011 for application No. 2006-233763.

Japanese Notification of Reasons for Refusal dated Mar. 8, 2011 for application No. 2006-233763.

* cited by examiner

AMPLITUDE
FRAME LENGTH L
CORRECTING SIGNAL
f(t) (ex.W1+W2)
f(0)
WAVEFORM W2
(FREQUENCY f2)
WAVEFORM W1
(FREQUENCY f1)

0
TIME t
f(L)
ADJUSTED
CORRECTING SIGNAL
fa(t)
ADJUST AMPLITUDE
COMPONENT OF f(t)
TIME-DOMAIN FRAME SIGNAL
Y(t)

0
TIME t
Y(0)
FRAME END AMPLITUDE
Y(L)(=Y(0))
FRAME END AMPLITUDE
CALCULATE CORRECTED
FRAME SIGNAL Yc(t)
(Yc(t)=Y(t)-fa(t))
CORRECTED FRAME SIGNAL
Yc(t)

0
TIME t

AMPLITUDE
FRAME LENGTH L
f(0)
CORRECTING SIGNAL f(t) (=C0)
C0
f(L)(=C0)

0
TIME t
ADJUST AMPLITUDE COMPONENT OF f(t) (fa(t)=Y(0))
TIME-DOMAIN FRAME SIGNAL Y(t)

0
TIME t
Y(0) FRAME END AMPLITUDE
fa(t) ADJUSTED CORRECTING SIGNAL
Y(L)(=Y(0)) FRAME END AMPLITUDE
CALCULATE CORRECTED FRAME SIGNAL Yc(t) (Yc(t)=Y(t)-Y(0))
CORRECTED FRAME SIGNAL Yc(t)

0
TIME t

FIG.13A
FIG.13B
FIG.13C
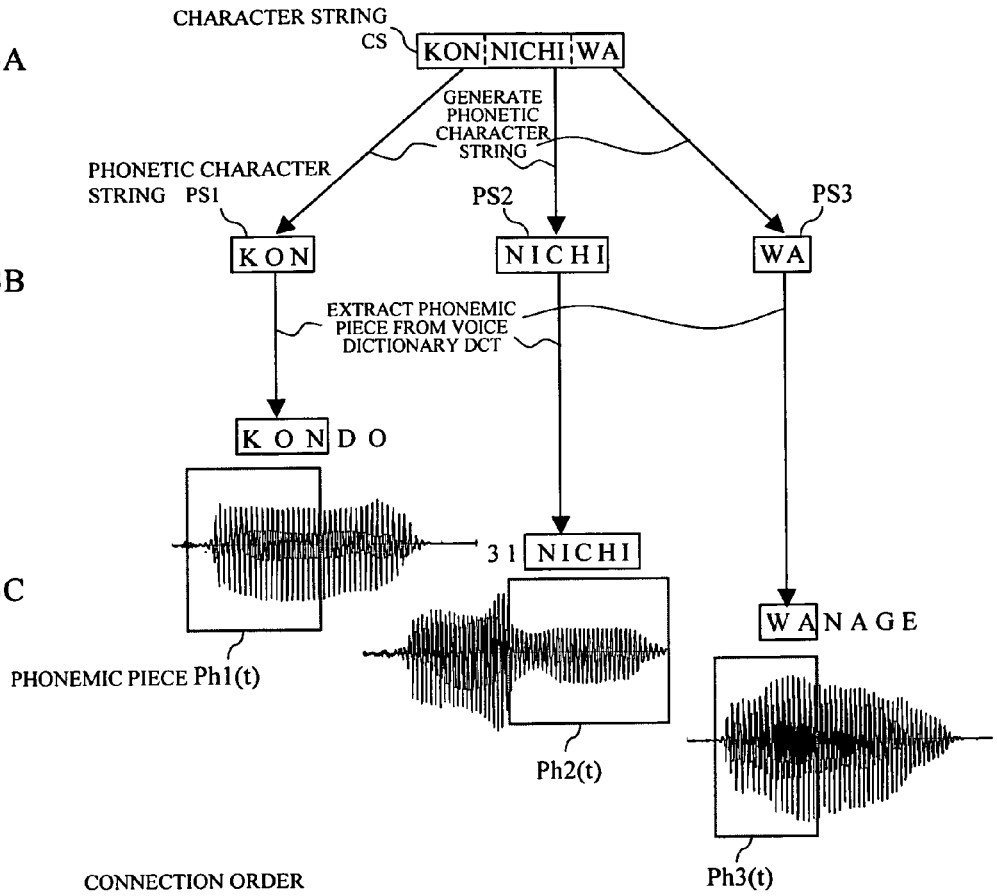
FIG.13D
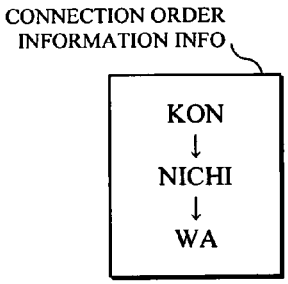

NOISE SUPPRESSING APPARATUS 2

FRAME SIGNAL CORRECTING METHOD AND APPARATUS WITHOUT DISTORTION

BACKGROUND OF THE INVENTION

1. Field of the Invention

The present invention relates to a signal processing method and apparatus, and in particular to a signal processing method and apparatus when processing such as a noise suppression is performed to a signal in a frequency domain and then the signal is returned to a time domain to be processed.

2. Description of the Related Art

Prior art examples [1] and [2] of a signal processing technology as mentioned above will now be described referring to FIGS. 14-17.

Prior Art Example [1]: FIGS. 14 and 15

A noise suppressing apparatus 2 shown in FIG. 14 is composed of a frame division/windowing portion 10 which divides an input signal In(t) that is a voice signal into units of a predetermined length and performs a predetermined window function, a frequency spectrum converter 20 which converts a windowed frame signal W(t) outputted from the frame division/windowing portion 10 into a frequency spectrum X(f) composed of an amplitude component |X(f)| and a phase component argX(f), a noise suppressing portion 130 which performs a noise suppression to the amplitude component |X(f)| of the frequency spectrum X(f), a time-domain converter 40 which converts the amplitude component |Xs(f)| after the noise suppression and the phase component argx(f) of the frequency spectrum X(f) into the time domain, and a frame synthesizing portion 60 which synthesizes a time-domain frame signal Y(t) outputted from the time-domain converter 40.

FIG. 15 shows an operation waveform diagram of the noise suppressing apparatus 2. Firstly, the frame division/windowing portion 10 sequentially divides the input signal In(t) into a last frame signal FRb(t) and a present frame signal FRp(t) (hereinafter, occasionally represented by a reference character FR) of a predetermined frame length L. The frame signals FRb(t) and FRp(t) are deviated by frame shift length ΔL and cut out from the input signal In(t) so that the parts of the signals may be overlapped with each other, in order to more accurately perform processing for noise suppression (namely, in order to more minutely analyze the frequency spectrum), which will be described later.

Furthermore, the frame division/windowing portion 10 sequentially performs a predetermined window function w(t) to the frame signals FRb(t) and FRp(t) according to the following Eq.(1) to output the windowed frame signal W(t) (at step T1).

$$\cdot W(t)=FR(t)*w(t)\ (t=0-L) \qquad \text{Eq.(1)}$$

This window function w(t) is set, as shown in FIG. 15 for example, so that the amplitudes of both ends of the frame signals FR(t) may become equally "0" and the sum of mutual contribution degrees at the overlapping portion of the frame signals FR(t) may become "1".

The operation of the frequency spectrum converter 20, the noise suppressing portion 130, and the time-domain converter 40 will now be described by taking the windowed frame signal Wb(t) obtained corresponding to the last frame signal FRb(t) for example. This can be similarly applied to the windowed frame signal Wp(t) corresponding to the present frame signal FRp(t).

The frequency spectrum converter 20 converts the windowed frame signal Wb(t) into the frequency spectrum X(f) by using an orthogonal transform method such as MDCT (Modified Discrete Cosine Transform) and FFT (Fast Fourier Transform), provides the amplitude component |X(f)| to the noise suppressing portion 130, and provides the phase component argX(f) to the time-domain converter 40.

The noise suppressing portion 130 suppresses the noise component included in the amplitude component |X(f)|, and provides the amplitude component |Xs(f)| after the noise suppression to the time-domain converter 40 (at step T2).

The time-domain converter 40 having received the phase component argx(f) of the frequency spectrum X(f) and a noise suppressed amplitude component |Xs(f)| provides a time-domain frame signal Yb(t) obtained by the conversion into the time domain (reverse orthogonal transform) to the frame synthesizing portion 60 (at step T3).

The frame synthesizing portion 60 having received the time-domain frame signal Yb(t) and a time-domain frame signal Yp(t) corresponding to the present frame signal FRp(t) similarly obtained synthesizes or adds the time-domain frame signals Yb(t) and Yp(t) as shown by the following Eq.(2) to obtain an output signal Out(t) (at step T4).

$$\begin{aligned}\cdot \mathrm{Out}(t) &= Y(t-\Delta L)+Y(t) \\ &= Yb(t)+Yp(t)\end{aligned} \qquad \text{Eq. (2)}$$

Thus, it becomes possible to obtain the output signal Out(t) in which the noise component is suppressed, from the input signal In(t).

However, the amplitude at each end of the frame of the time-domain frame signal Yb(t) or Yp(t) becomes larger or smaller than "0" as shown in FIG. 15 due to the noise suppression at the above-mentioned step T2, so that the amplitudes of the frame end are mutually deviated in some cases. In these cases, there is a problem in this prior art example [1] that the output signal Out(t) becomes discontinuous at boundaries B1 and B2 of the time-domain frame signals Yb(t) and Yp(t), so that abnormal noise is generated.

In order to address this problem, the following prior art example [2] has already been proposed.

Prior Art Example [2]: FIGS. 16 and 17

The noise suppressing apparatus 2 shown in FIG. 16 is provided with a post-windowing portion 140 which is connected between the time-domain converter 40 and the frame synthesizing portion 60, and which outputs a post-windowed frame signal Wa(t) in which a post-window function is performed to the time-domain frame signal Y(t), in addition to the arrangement shown in the above-mentioned prior art example [1].

In operation, as shown in FIG. 17, the post-windowing portion 140 sequentially performs a predetermined post-window function wa(t) to the time-domain frame signals Yb(t) and Yp(t) obtained in the same way as the above-mentioned prior art example [1] according to the following Eqs.(3) and (4) to output the post-windowed frame signals Wab(t) and Wap(t) (at step T5).

$$\cdot Wab(t)=Yb(t)*wa(t) \qquad \text{Eq.(3)}$$

$$\cdot Wap(t)=Yp(t)*wa(t) \qquad \text{Eq.(4)}$$

The post-window function wa(t) is set so that the amplitudes of both ends of the time-domain frame signals Yb(t) and Yp(t) may become "0" again as shown in FIG. 17 (i.e. so that the amplitudes may become continuous at the boundaries B1 and B2 of the time-domain frame signals Yb(t) and Yp(t)).

The frame synthesizing portion 60 synthesizes or adds the post-windowed frame signals Wab(t) and Wap(t) as shown in the following Eq.(5) to obtain the output signal Out(t) (at step T6).

$$\begin{aligned} \cdot \mathrm{Out}(t) &= Wa(t-\Delta L) + Wa(t) \\ &= Wab(t) + Wap(t) \end{aligned} \quad \text{Eq. (5)}$$

Thus, it becomes possible to obtain the output signal Out(t) in which the time-domain frame signals Yb(t) and Yp(t) are continuously connected at the boundaries B1 and B2 (see e.g. patent document 1).

It is to be noted that as a reference example, an echo suppressing apparatus can be mentioned which connects the frame signals obtained by converting the frequency spectrum to which an echo suppression is performed into a time domain by using the post-window function in the same way as the above-mentioned prior art example [2] (see e.g. patent document 2).

[Patent document 1] Japanese patent No. 3626492

[Patent document 2] Japanese patent application laid-open No. 2000-252891

In the above-mentioned prior art example [2], it is possible to continuously connect the frame signals after the correction by sequentially correcting the frame signals by using the post-window function. However, since the amplitude component of the frame signal is multiplied by the post-window function, in other words, since the amplitude component |Xs(f)| corresponding to all of the frequency components included in the frame signal are corrected, as shown in FIG. 18, there is a problem that the frequency spectrum amplitude component |Xa(f)| (shown by a solid line) of the frame signal Wa(t) after having taken the post-window function processing becomes blunt in the whole frequency bandwidth compared with the frequency spectrum amplitude component |Xs(f)| (shown by dotted line) of the frame signal Y(t) before taking the post-window function processing, so that a distortion is generated in the entire frame signal.

Generally, it is considered that a hearing sensitivity in a high frequency bandwidth whose frequency "f" is 20 Hz-20 kHz is high. Therefore, a distortion in the frame signal generated in the high frequency bandwidth leads to a deterioration of a sound quality.

SUMMARY OF THE INVENTION

It is accordingly an object of the present invention to provide a signal processing method and apparatus by which a deviation of amplitudes of a frame end which occurs upon converting a frequency spectrum to which processing such as a noise suppression is performed into a frame signal can be corrected with a minimum distortion generated in the frame signal.

[1] In order to achieve the above-mentioned object, a signal processing method (or apparatus) according to one aspect of the present invention comprises: a first step of (or means) performing predetermined processing to a frequency spectrum of a first frame signal of a predetermined length to which a predetermined window function is performed, to be converted into a time domain to generate a second frame signal; and a second step of (or means) adjusting a predetermined correcting signal having a same frame length as the second frame signal so that amplitudes of both ends of the correcting signal may substantially become equal to amplitudes of both or one of frame ends of the second frame signal, and of correcting the second frame signal by subtracting the adjusted correcting signal from the second frame signal.

Namely, amplitudes of both frame ends of a second frame signal obtained by performing predetermined processing to a frequency spectrum of a first frame signal at the first step (or means) and by converting the frequency spectrum into a time domain may become larger or smaller than "0" in the same way as the prior art example.

Therefore, at the second step (or means), a predetermined correcting signal is adjusted so that amplitudes of both ends of the correcting signal substantially become equal to amplitudes of both or one of frame ends of the second frame signal, and the correcting signal adjusted is subtracted from the second frame signal.

The correcting signal has only to have the same frame length as the second frame signal, and the amplitude component may be any amplitude component.

Namely, since the amplitude component of the correcting signal is composed of a plurality of frequency components, the amplitudes of both or one of the frame ends of the second frame signal become "0" or a value close to "0" by the above-mentioned adjustment and subtraction, so that the correction of decreasing or increasing only the amplitude component corresponding to the frequency components included in the correcting signal is performed.

Accordingly, it is possible to correct the deviation of the amplitudes of the frame end which occurs in the second frame signal without causing a distortion in the entire frame signal.

[2] Also, in the above-mentioned [1], an amplitude component of the correcting signal may include only a low frequency component.

Namely, it is possible to keep the distortion of the frame signal caused by the correction only in the low frequency bandwidth.

Specifically, when e.g. the first frame signal is obtained from a voice signal, and the amplitude component of the correcting signal includes only a component of a frequency bandwidth where hearing sensitivity is assumed to be low, the deviation of the amplitudes of the frame end which occurs in the second frame signal can be corrected without causing a deterioration of a sound quality.

[3] Also, in the above-mentioned [1], an amplitude component of the correcting signal may include only a direct current component.

In this case, the distortion of the frame signal caused by the correction can be kept minimum.

[4] Also, in order to achieve the above-mentioned object, a signal processing method (or apparatus) according to one aspect of the present invention comprises: a first step of (or means) performing predetermined processing to a frequency spectrum of a first frame signal of a predetermined length to which a predetermined window function is performed, to be converted into a time domain to generate a second frame signal; a second step of (or means) inputting the frequency spectrum to which the predetermined processing is performed and the second frame signal, and of correcting an amplitude component of the frequency spectrum to which the predetermined processing is performed so that amplitudes of both or one of frame ends of the second frame signal may substantially become null; and a third step of (or means) converting the corrected frequency spectrum into a time domain.

Namely, at the second step (or means), a correction in the frequency domain is performed so that a frame signal in which a frequency spectrum whose amplitude component is corrected is converted into a time domain before the time-domain conversion at the third step (or means) may become equal to the frame signal in which both or one of frame ends of the second frame signal is made substantially "0".

The correction has only to be performed to the amplitude component corresponding to an arbitrary frequency component within the frequency spectrum to which the predetermined processing is performed.

Namely, the amplitudes of both or one of the frame ends of the frame signal obtained by converting the corrected frequency spectrum into the time domain become "0" or a value close to "0", and only the amplitude component corresponding to the corrected frequency component is corrected.

Accordingly, in the same way as the above-mentioned [1], it is possible to correct the deviation or difference of the amplitudes of the frame end which occurs in the second frame signal without causing a distortion in the entire frame signal.

[5] Also, in the above-mentioned [4], the second step (or means) may comprise correcting an amplitude component corresponding to a low frequency bandwidth of the frequency spectrum to which the predetermined processing is performed.

Namely, the second step (or means) corrects any amplitude component corresponding to a low frequency bandwidth of the frequency spectrum to which the predetermined processing is performed.

Specifically, when the low frequency bandwidth is set in the frequency bandwidth where hearing sensitivity is assumed to be low, the deviation of the amplitudes of the frame end which occurs in the second frame signal can be corrected without a deterioration occurrence of the sound quality, in the same way as the above-mentioned [2].

[6] Also, in the above-mentioned [4], the second step (or means) may comprise correcting only an amplitude corresponding to a direct current component of the frequency spectrum to which the predetermined processing is performed.

Also this case, like the above-mentioned [3], the distortion of the frame signal caused by the correction can be kept minimum.

[7] Also, in the above-mentioned [1] or [4], the first step (or means) may include a step of (or means) converting the first frame signal into a frequency domain to generate a first frequency spectrum, a step of (or means) generating a second frequency spectrum in which the predetermined processing is performed to the first frequency spectrum, and a step of (or means) converting the second frequency spectrum into the time domain to generate the second frame signal.

[8] Also, in the above-mentioned [1] or [4], the predetermined processing of the first step (or means) may estimate a noise spectrum from an amplitude component of the frequency spectrum of the first frame signal, and may suppress noise within an amplitude component of the frequency spectrum of the first frame signal based on the noise spectrum.

[9] Also, in the above-mentioned [1] or [4], the predetermined processing of the first step (or means) may comprise calculating a suppression coefficient for suppressing an echo by comparing an amplitude component of a frequency spectrum of a reference frame signal to which the predetermined window function is performed with the amplitude component of the frequency spectrum of the first frame signal, and multiplying the amplitude component of the frequency spectrum of the first frame signal by the suppression coefficient.

[10] Also, in the above-mentioned [1] or [4], the first frame signal may comprise a voice signal or an acoustic signal to which the predetermined window function is performed, the predetermined processing may comprise encoding for the frequency spectrum of the first frame signal, and the first step (or means) may include a step of (or means) decoding by converting the encoded frequency spectrum into the time domain to generate the second frame signal.

[11] Also, in the above-mentioned [1] or [4], the first frame signal may comprise a phonemic piece corresponding to one phonetic character string of a plurality of phonetic character strings generated by analyzing an arbitrary character string, the phonemic piece being extracted from a voice dictionary in which all phonetic character strings estimated and phonetic pieces corresponding thereto are recorded and to which the predetermined window function is performed, a frame signal adjacent to the first frame signal with a partial overlap with each other may comprise a phonemic piece corresponding to another phonetic character string of the phonetic character strings, the phonemic piece being extracted from the voice dictionary and to which the predetermined window function is performed, and the predetermined processing may comprise determining a connection order of the phonemic pieces from a length and a pitch generated from the phonetic character strings, calculating an amplitude correction coefficient for mutually connecting the frequency spectrums of the phonetic pieces smoothly based on the connection order, and multiplying the amplitude component of the frequency spectrum of each phonemic piece by each amplitude correction coefficient.

In the same way as the above-mentioned [8]-[11], when various frame signals are inputted and various processings are performed to the frequency spectrum, the deviation of the amplitudes of the frame end caused by the time-domain conversion can be corrected without changing the elements of the signal processing method and apparatus.

[11] Also, in the above-mentioned [1] or [4], the signal processing method (or apparatus) may further comprise a step of (or means) adding overlap portions of a frame signal obtained by correcting a present frame signal, and a frame signal obtained by correcting a frame signal immediately before the present frame signal, where the frame signal and the adjacent frame signal partially overlap with each other.

Thus, when amplitudes of both of the frame ends in the above-mentioned [1] or [4] are substantially corrected to "0" for the frame signals partially overlap with each other, the amplitudes of both of the frame ends of the frame signals are respectively made equal, thereby enabling its boundaries of the frame signals to be continuous.

Also, when the amplitudes of one of the frame ends of the frame signals are substantially corrected to "0" in the above-mentioned [1] or [4], frame signals without continuity may exist. However, the deviation itself of the amplitudes of the frame end which occurs in the frame signal is corrected without causing a distortion as mentioned above, thereby exerting no influence upon the sound quality.

According to the present invention, the deviation of the amplitudes of the frame end which occurs upon converting the frequency spectrum to which processing such as a noise suppression is performed into the time-domain frame signal can be corrected with minimum distortion in the frame signal, thereby enabling a quality of output signal of the apparatus which applies the present invention to be improved.

Also, the present invention is arranged so that a direct current component of the frame signal or only an amplitude component corresponding to the low frequency bandwidth can be corrected. Therefore, the quality deterioration of the frame signal caused by the correction can be reduced.

Furthermore, it is made possible for the arrangement of the present invention to accommodate to various frame signals and processings without being changed. Therefore, the present invention can be commonly applied to various apparatuses, so that development costs can be reduced.

BRIEF DESCRIPTION OF THE DRAWINGS

The above and other objects and advantages of the invention will be apparent upon consideration of the following detailed description, taken in conjunction with the accompanying drawings, in which the reference numerals refer to like parts throughout and in which:

FIGS. 13A-13D are diagrams showing an operation example of a language processor, a rhythm generator, and a controller used for an application example [4] of the present invention;

DESCRIPTION OF THE EMBODIMENTS

Embodiments [1] and [2] of a signal processing method according to the present invention and an apparatus utilizing the same, and application examples [1]-[4] will now be described in the following order by referring to FIGS. 1, 2, 3A-3C, 4, 5A-5C, 6-12, and 13A-13D.

Figure 1:
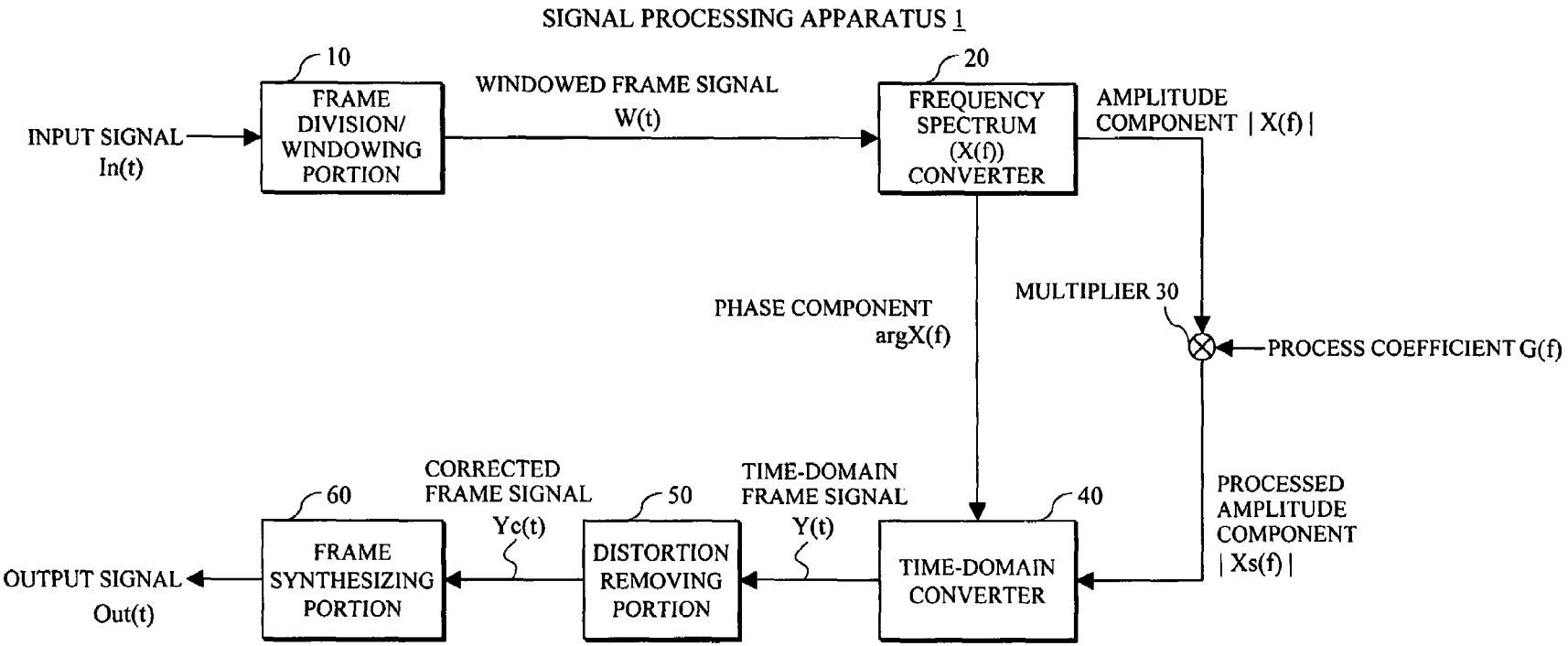
FIG. 1 is a block diagram showing an embodiment [1] of a signal processing method and apparatus according to the present invention.
Figure 2:
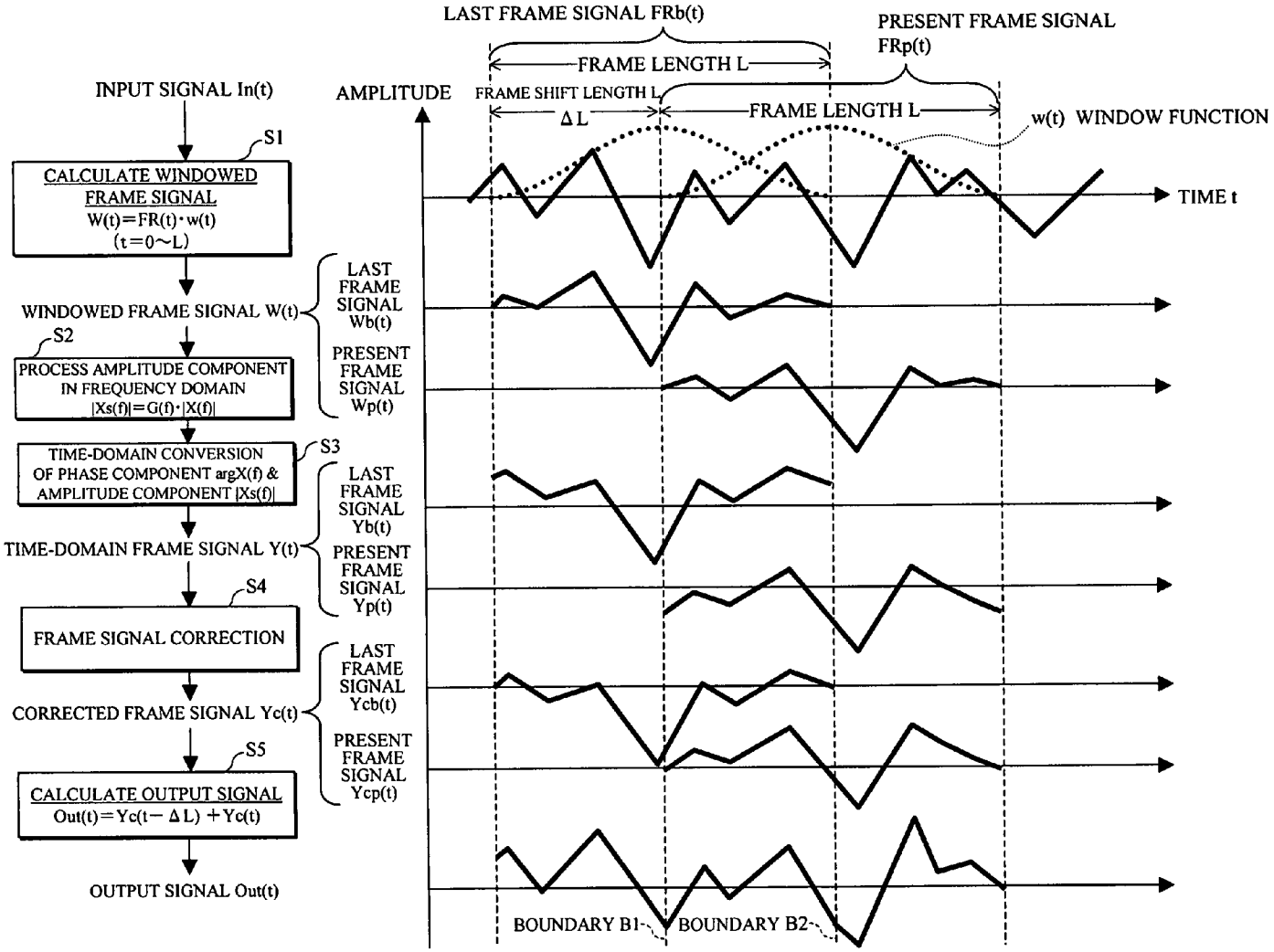
FIG. 2 is a waveform diagram showing an overall operation example of the embodiment [1] of the present invention.
Figure 6:
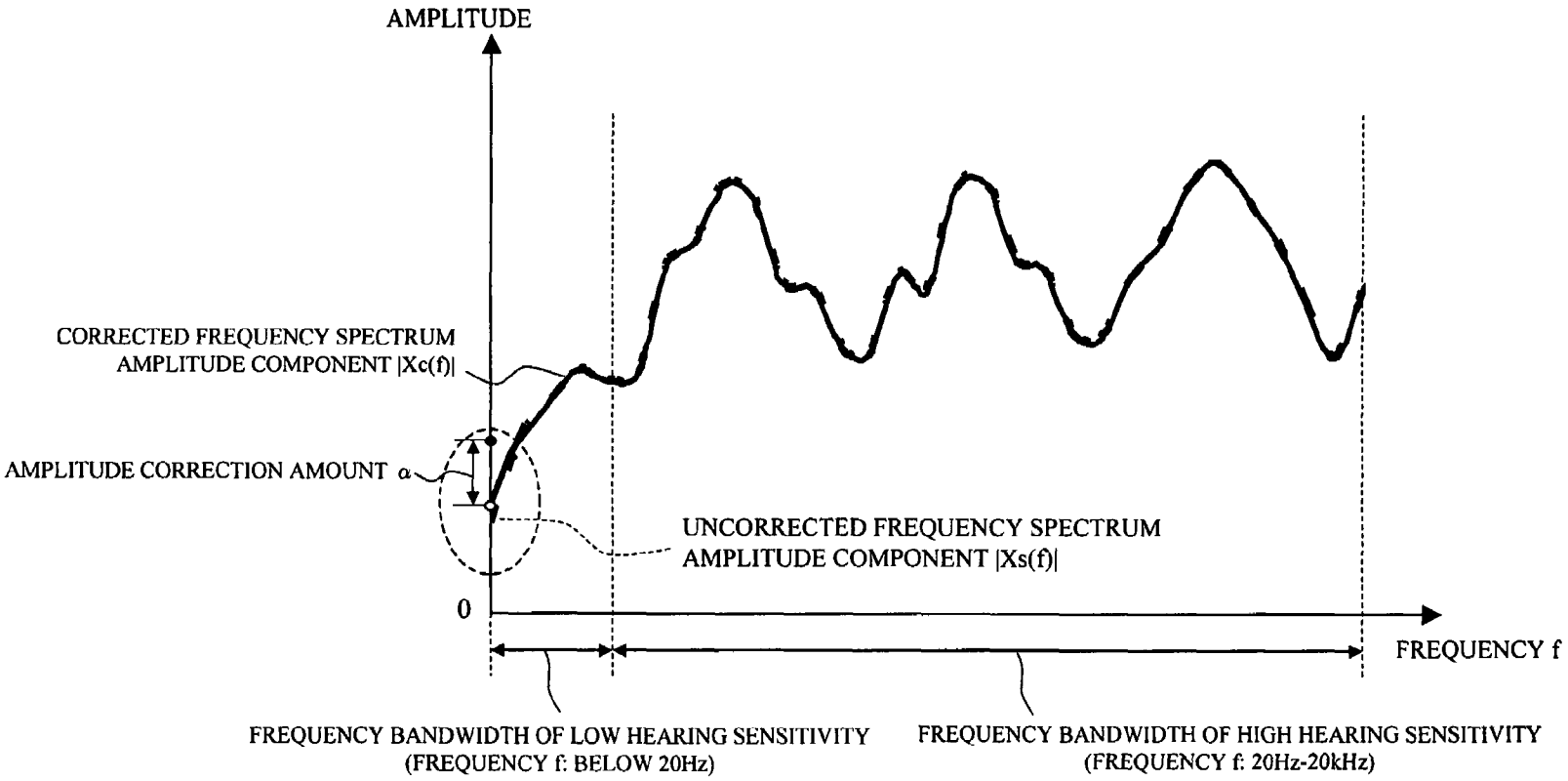
FIG. 6 is a graph diagram showing a frequency spectrum characteristic before and after the correction by the frame signal correcting example (2) of the distortion removing portion used for the embodiment [1] of the present invention.
Figure 7:
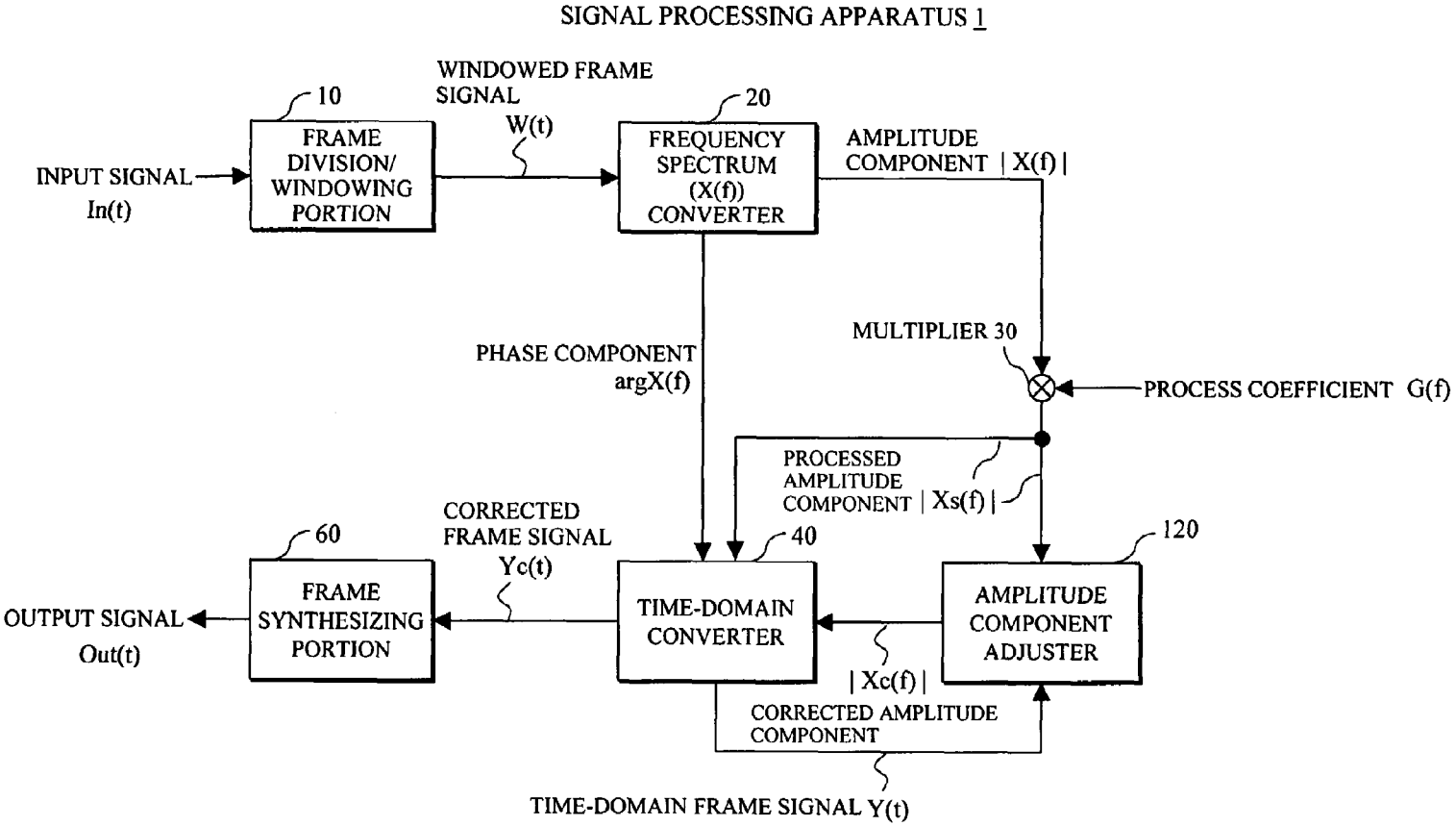
FIG. 7 is a block diagram showing an embodiment [2] of a signal processing method and apparatus according to the present invention.
Figure 8:
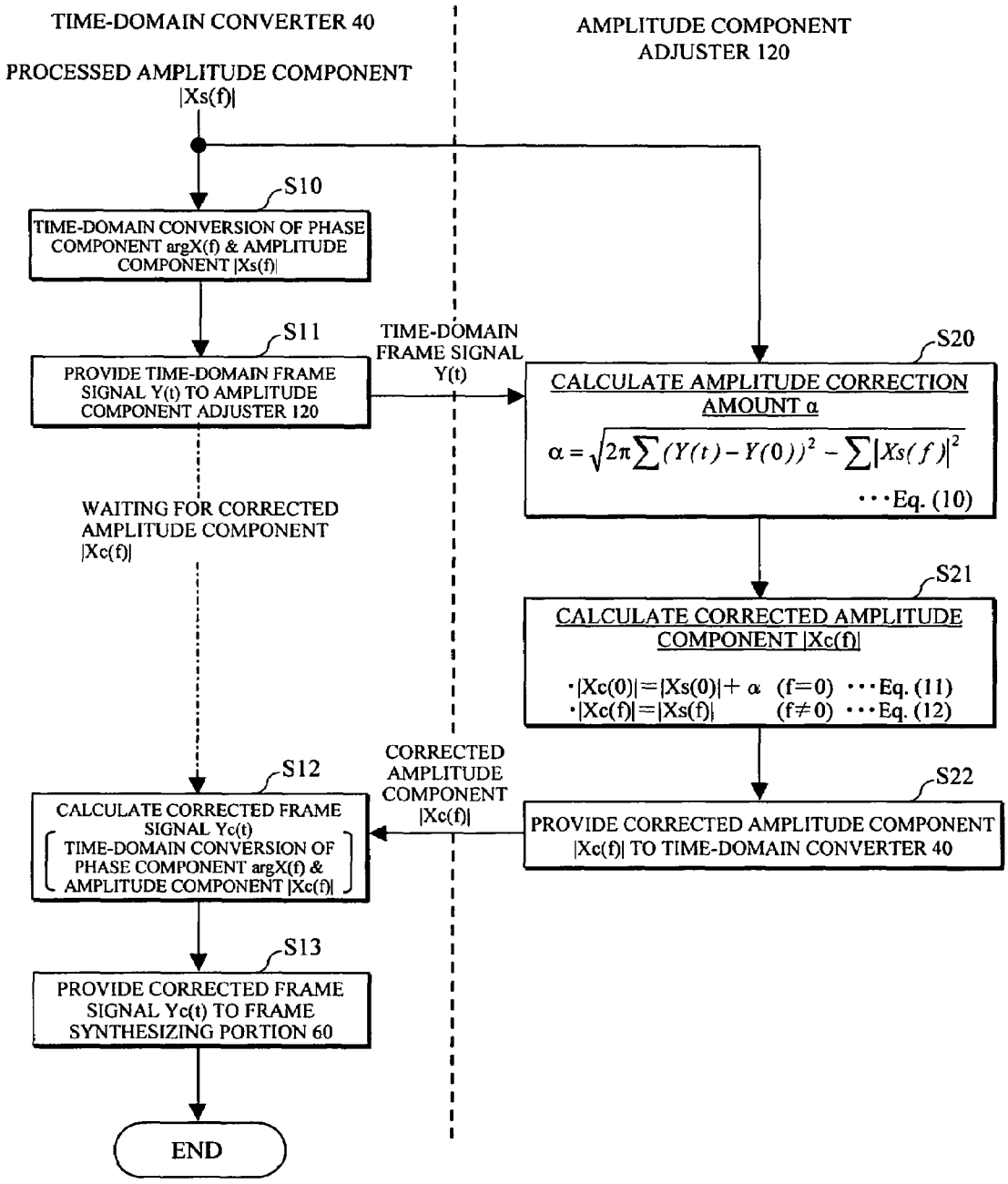
FIG. 8 is a flowchart showing an operation example of a time-domain converter and an amplitude component adjuster used for the embodiment [2] of the present invention.
Figure 9:
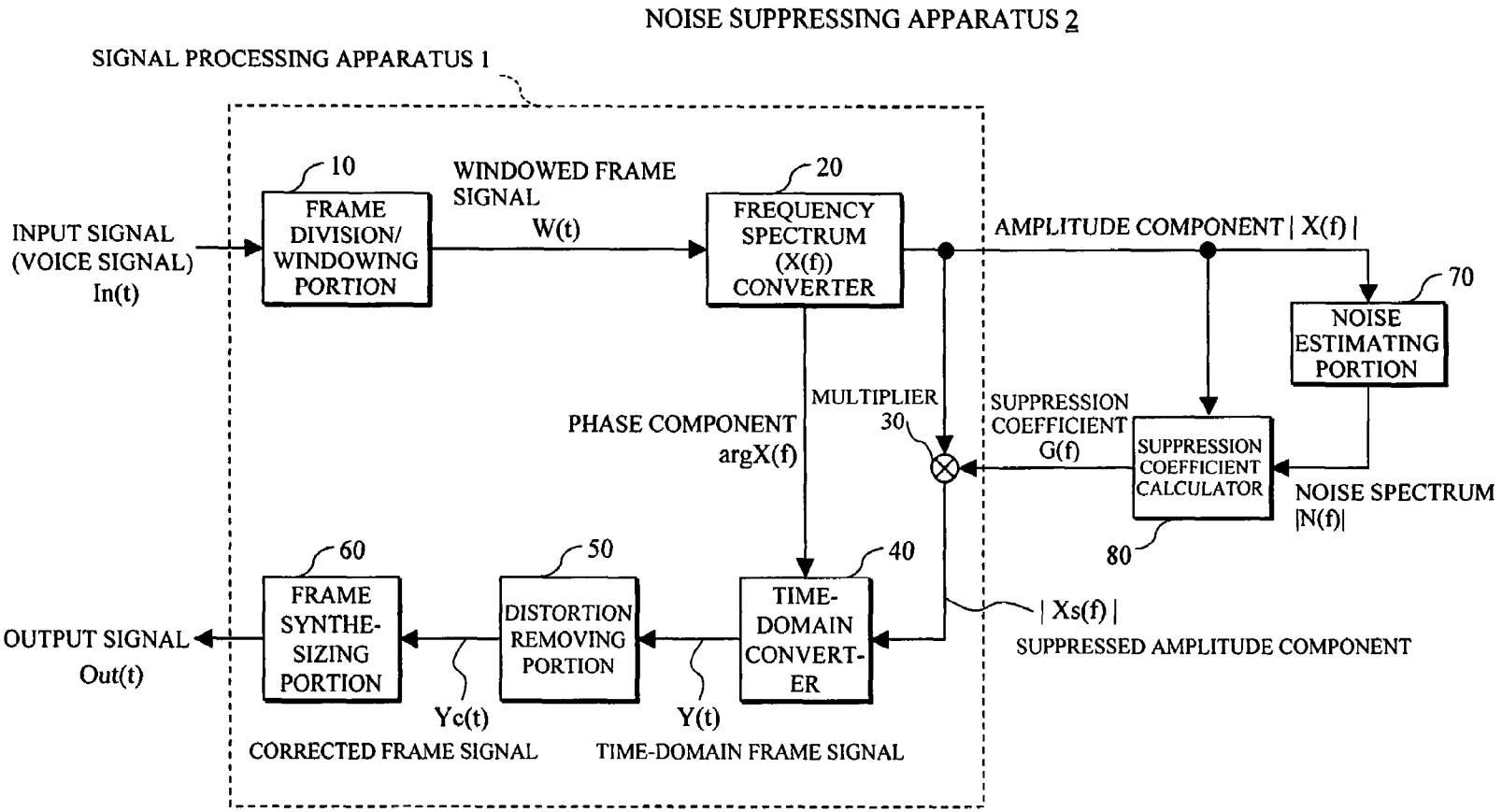
FIG. 9 is a block diagram showing an application example [1] of a signal processing method and apparatus according to the present invention.
Figure 10:
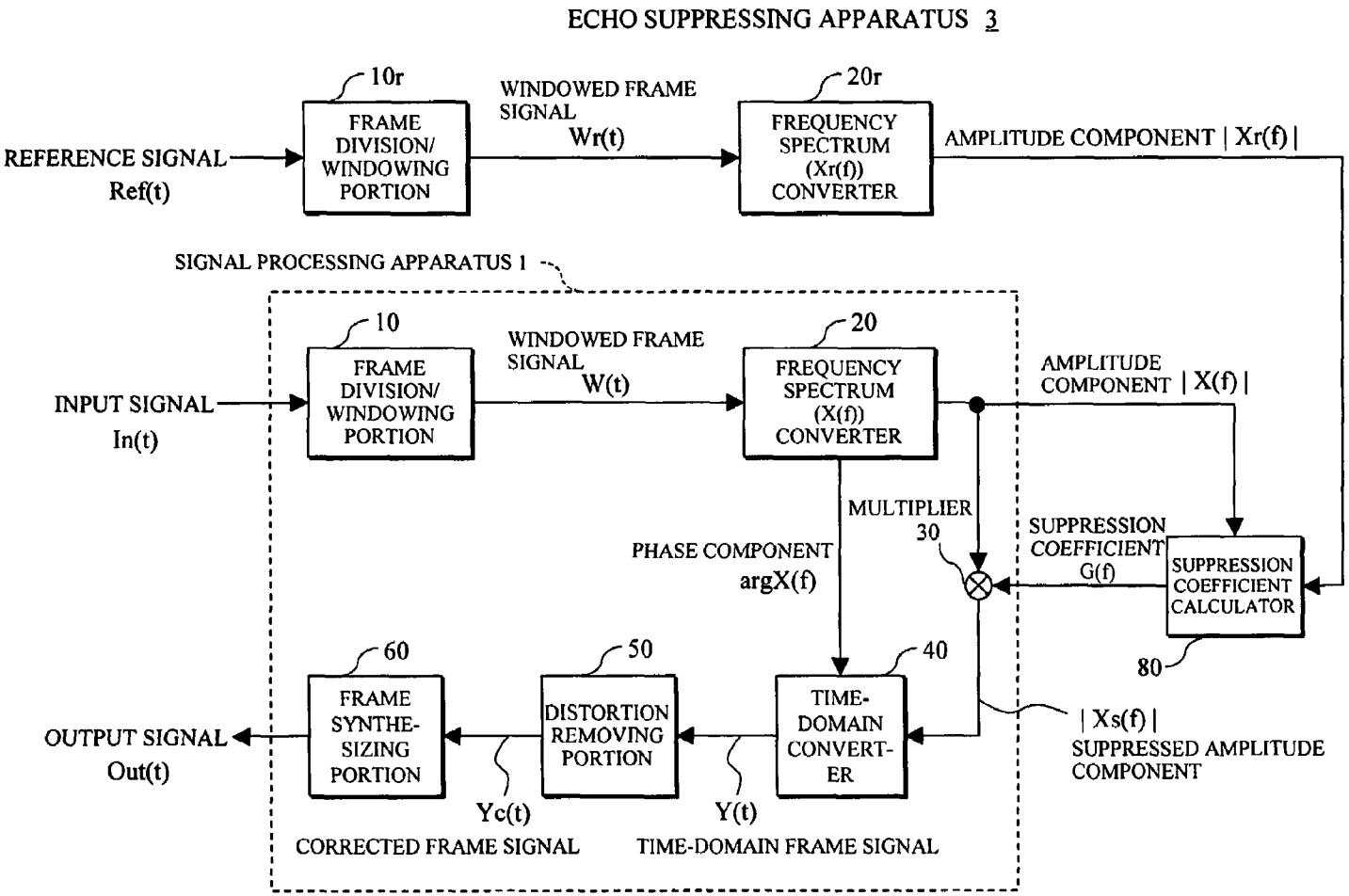
FIG. 10 is a block diagram showing an application example [2] of a signal processing method and apparatus according to the present invention.
Figure 11:
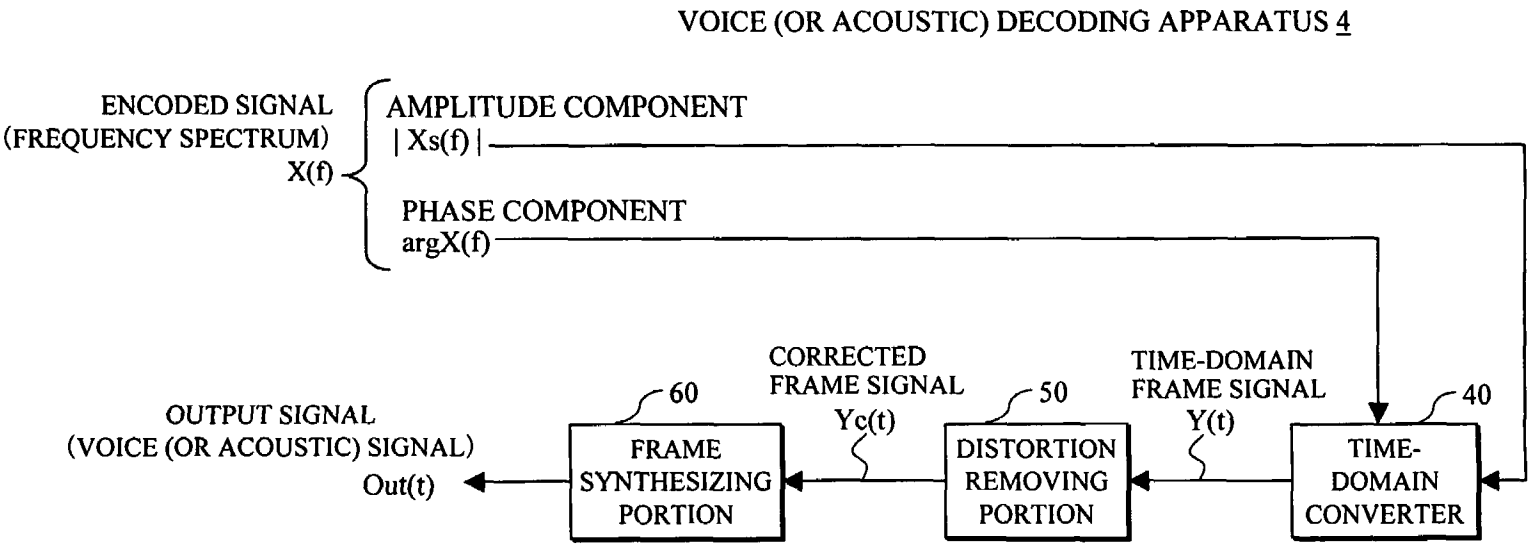
FIG. 11 is a block diagram showing an application example [3] of a signal processing method and apparatus according to the present invention.
Figure 12:
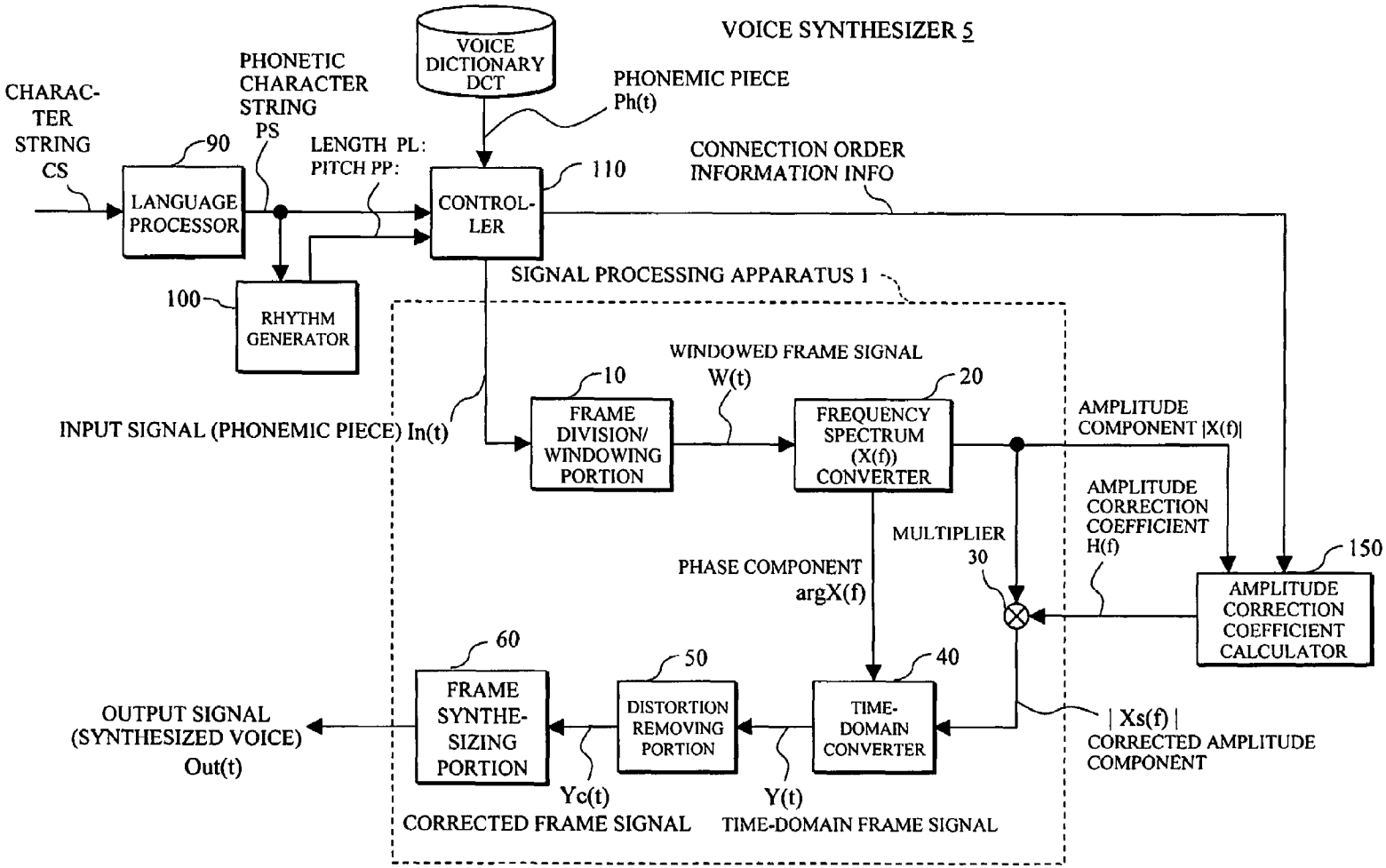
FIG. 12 is a block diagram showing an application example [4] of a signal processing method and apparatus according to the present invention.

I. Embodiment [1]: FIGS. 1, 2, 3A-3C, 4, 5A-5C, and 6
I.1. Arrangement: FIG. 1
I.2. Operation examples: FIGS. 2, 3A-3C, 4, 5A-5C, and 6
I.2.A. Overall operation example: FIG. 2
I.2.B. Frame signal correcting example (1): FIGS. 3A-3C, and 4
I.2.C. Frame signal correcting example (2): FIGS. 5A-5C, and 6
II. Embodiment [2]: FIGS. 4, and 6-8
II.1. Arrangement: FIG. 7
II.2. Operation examples: FIGS. 4, 6, and 8
III. Application examples: FIGS. 9-12, and 13A-13D
III.1. Application example [1] (noise suppressing apparatus): FIG. 9
III.2. Application example [2] (echo suppressing apparatus): FIG. 10
III.3. Application example [3] (voice (or acoustic) decoding apparatus): FIG. 11
III.4. Application example [4] (voice synthesizer): FIGS. 12, and 13A-13D

I. Embodiment [1]: FIGS. 1, 2, 3A-3C, 4, 5A-5C, and 6

I.1. Arrangement: FIG. 1

A signal processing apparatus 1 according to the embodiment [1] of the present invention shown in FIG. 1 is composed of a frame division/windowing portion 10 which divides an input signal In(t) into units of a predetermined length and performs a predetermined window function to the signal, a frequency spectrum converter 20 which converts a windowed frame signal W(t) outputted from the frame division/windowing portion 10 into a frequency spectrum X(f) composed of an amplitude component |X(f)| and a phase component argX(f), a multiplier 30 which multiplies a process coefficient G(f) for performing predetermined processing by the amplitude component |X(f)| of the frequency spectrum X(f), a time-domain converter 40 which converts the processed amplitude component |Xs(f)| and the phase component argX(f) of the frequency spectrum X(f) into the time domain, a distortion removing portion 50 which corrects a time-domain frame signal Y(t) outputted from the time-domain converter 40 by using a predetermined correcting signal, and a frame synthesizing portion 60 which synthesizes a corrected frame signal Yc(t) outputted from the distortion removing portion 50.

The process coefficient G(f) inputted to the multiplier 30 can be appropriately set according to an intended purpose of the signal processing apparatus 1.

I.2. Operation Examples: FIGS. 2, 3A-3C, 4, 5A-5C, and 6

The operation of the signal processing apparatus 1 shown in FIG. 1 will now be described. Firstly, its overall operation example will be described referring to FIG. 2. Then, frame signal correcting examples (1) and (2) of the distortion removing portion 50 will be described referring to FIGS. 3A-3C, 4, 5A-5C, and 6.

I.2.A. Overall Operation Example: FIG. 2

Figure 14:
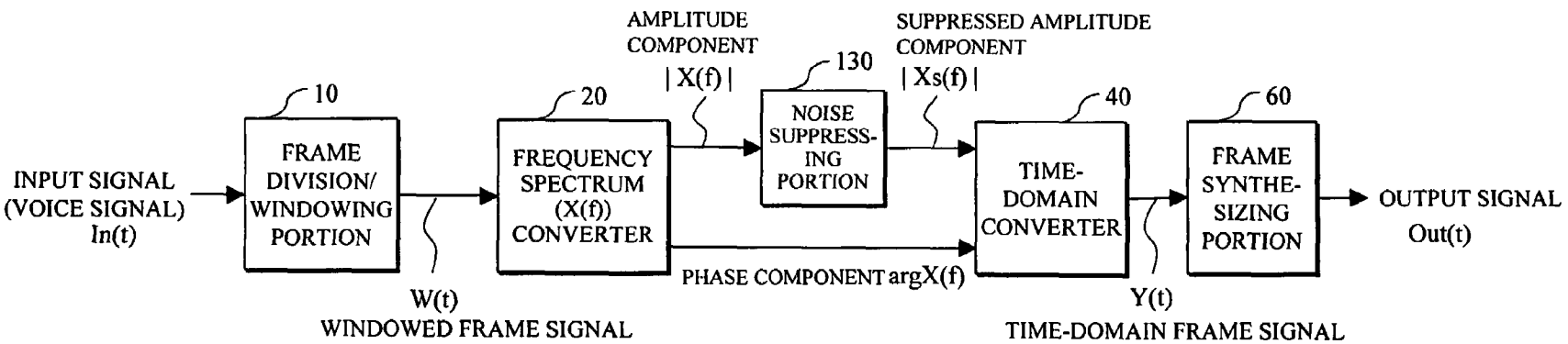
FIG.14 PRIOR ART
FIG. 14 is a block diagram showing an arrangement of a prior art example [1] of a noise suppressing apparatus.
Figure 15:
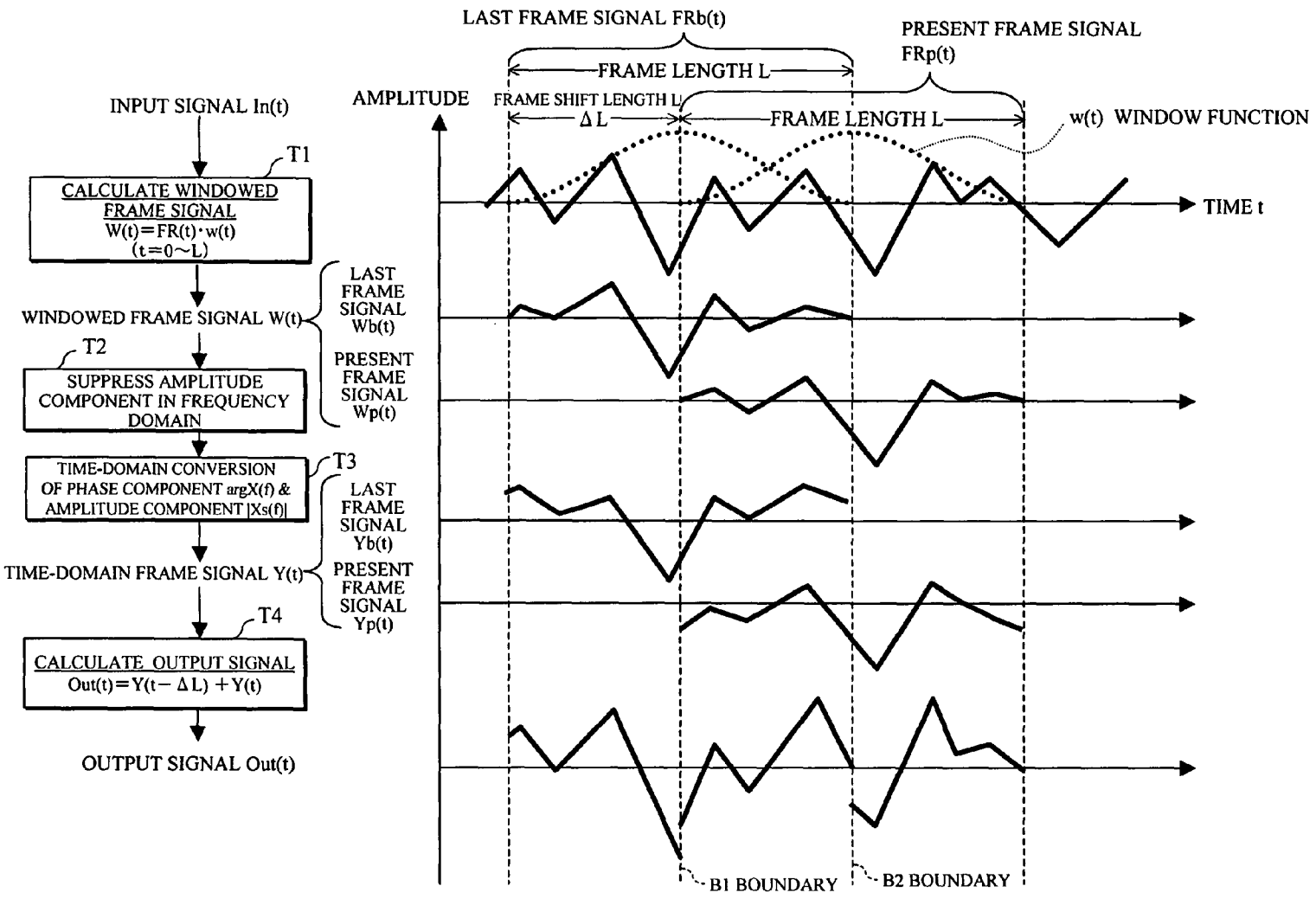
FIG.15 PRIOR ART
FIG. 15 is an operation waveform diagram showing a signal processing example of the prior art example [1]
Figure 16:
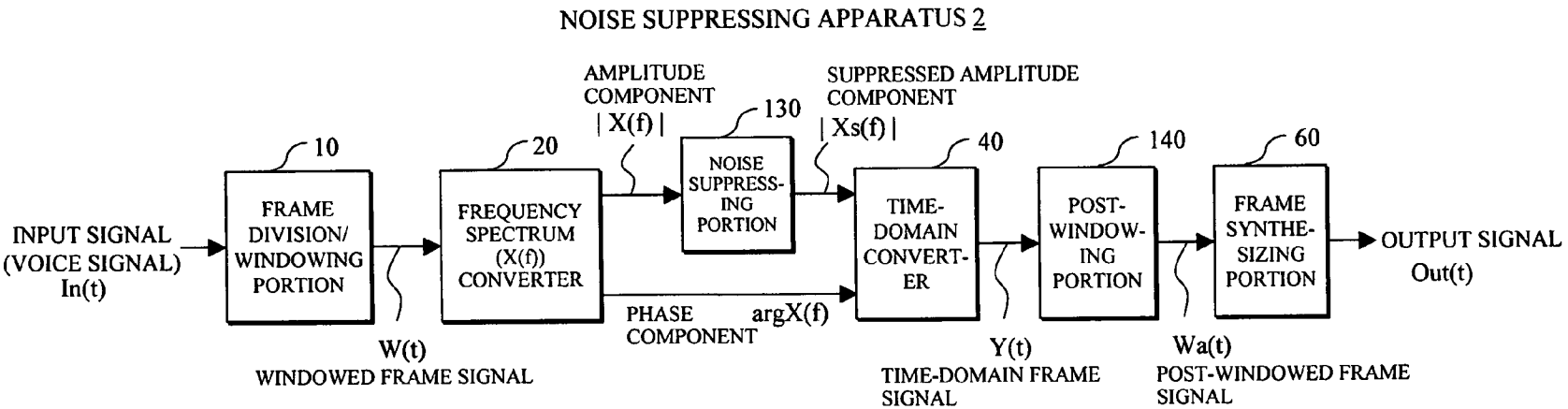
FIG.16 PRIOR ART
FIG. 16 is a block diagram showing an arrangement of a prior art example [2] of a noise suppressing apparatus.
Figure 17:
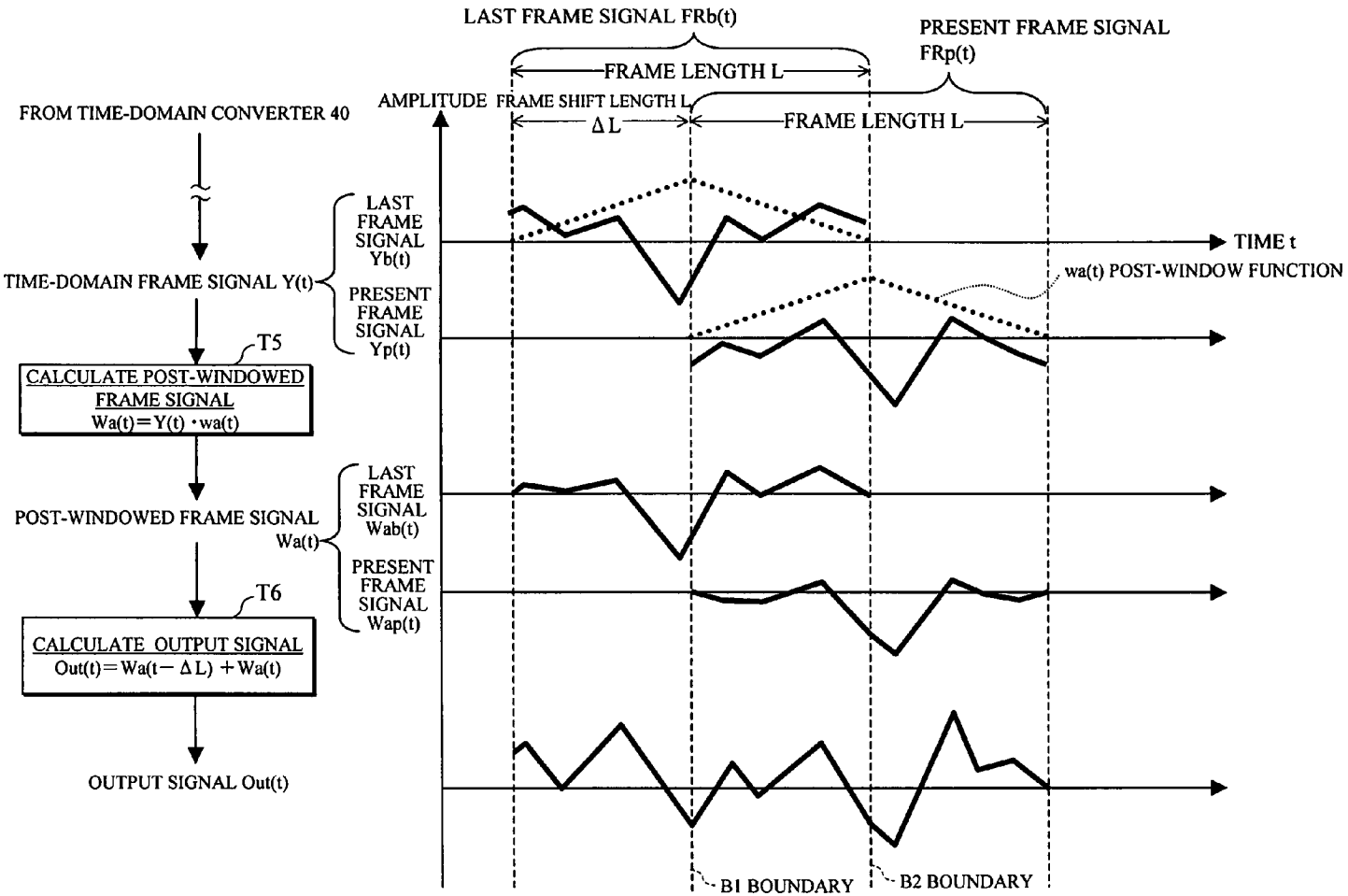
FIG.17 PRIOR ART
FIG. 17 is an operation waveform diagrams showing a signal processing example of a prior art example [2]
Figure 18:
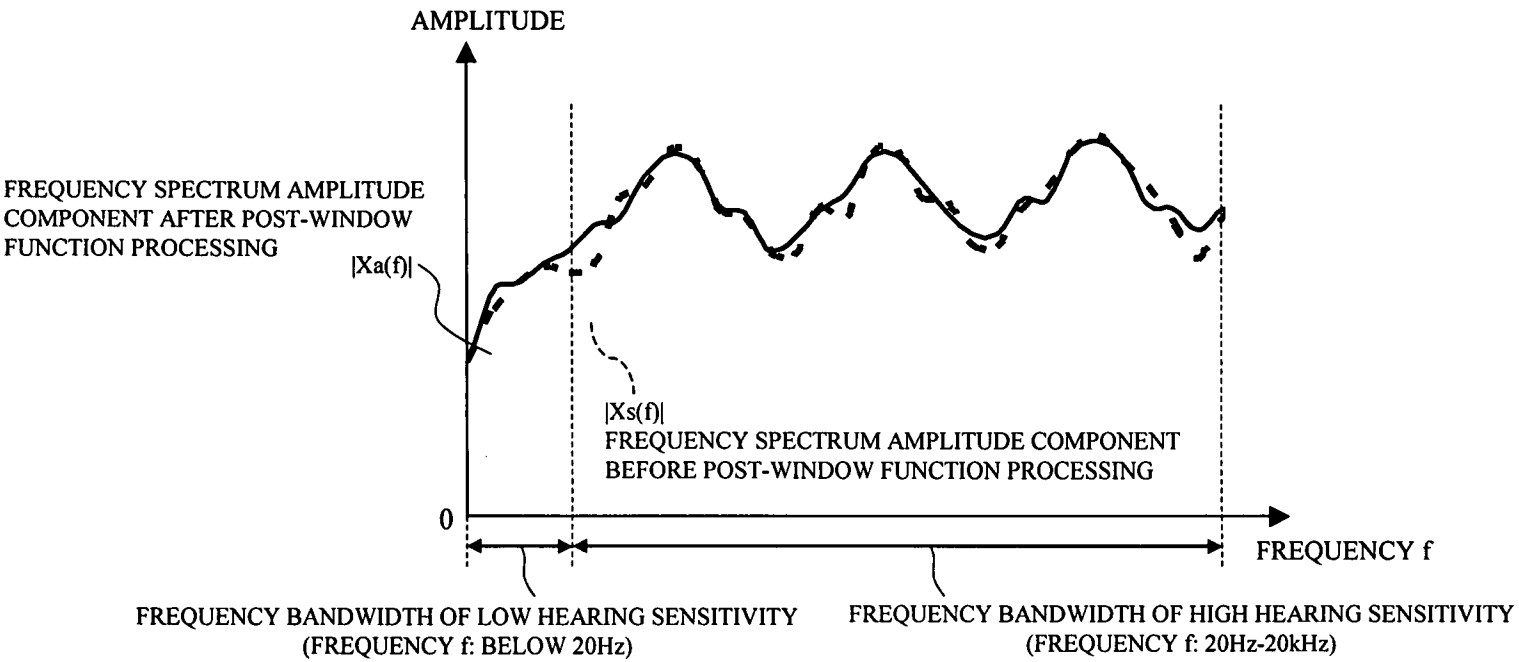
FIG.18 PRIOR ART
FIG. 18 is a graph diagram showing a frequency spectrum characteristic before and after post-window function processing by the prior art example [2].

Firstly, in the waveform diagrams shown in FIG. 2, the frame division/windowing portion 10 sequentially divides the input signal In(t) into a last frame signal FRb(t) and a present frame signal FRp(t) of a predetermined frame length L in the same way as the prior art example of FIG. 14, and sequentially multiplies the frame signals FRb(t) and FRp(t) by the predetermined window function w(t) as shown in the above-mentioned Eq.(1) and outputs the windowed frame signal W(t) (at step S1).

Hereinafter, the operation of the frequency spectrum converter 20, the multiplier 30, the time-domain converter 40, and the distortion removing portion 50 will be described by taking for example the windowed frame signal Wb(t) obtained corresponding to the last frame signal FRb(t). The same can be applied to the windowed frame signal Wp(t) corresponding to the present frame signal FRb(t).

The frequency spectrum converter 20 converts the windowed frame signal Wb(t) into the frequency spectrum X(f) by using the same orthogonal transform method as the prior art example, provides the amplitude component |X(f)| to the multiplier 30, and provides the phase component argX(f) to the time-domain converter 40.

The multiplier 30 multiplies or processes the amplitude component |X(f)| by the process coefficient G(f) to generate the amplitude component |Xs(f)| as shown in the following Eq.(6), and provides the amplitude component to the time-domain converter 40 (at step S2).

$$\cdot |Xs(f)| = G(f) * |X(f)| \qquad \text{Eq.(6)}$$

The time-domain converter 40 having received the phase component argX(f) and the processed amplitude component |Xs(f)| performs a reverse orthogonal transform in the same way as the prior art example, obtains the time-domain frame signal Yb(t), and provides the frame signal Yp(t) to the distortion removing portion 50 (at step S3).

The distortion removing portion 50 performs frame signal correction, which will be described later, to the time-domain frame signal Yb(t), and provides a corrected frame signal Ycb(t) to the frame synthesizing portion 60 (at step S4).

The frame synthesizing portion 60 having received the corrected frame signal Ycb(t) and a corrected frame signal Ycp(t) corresponding to the present frame signal FRp(t) obtained in the same way as the corrected frame signal Ycb(t) synthesizes or adds the corrected frame signals Ycb(t) and Ycp(t) as shown in Eq.(7), and obtains the output signal Out(t) (at step S5). It is to be noted that A L indicates a shift length of the present frame FRp(t) from the last frame signal FRb(t) in the same way as the above-mentioned Eq.(2).

$$\begin{aligned} \cdot \mathrm{Out}(t) &= Yc(t - \Delta L) + Yc(t) \\ &= Ycb(t) + Ycp(t) \end{aligned} \qquad \text{Eq. (7)}$$

I.2.B. Frame Signal Correcting Example (1): FIGS. 3A-3C, and 4

Figures 3A, 3B, 3C:
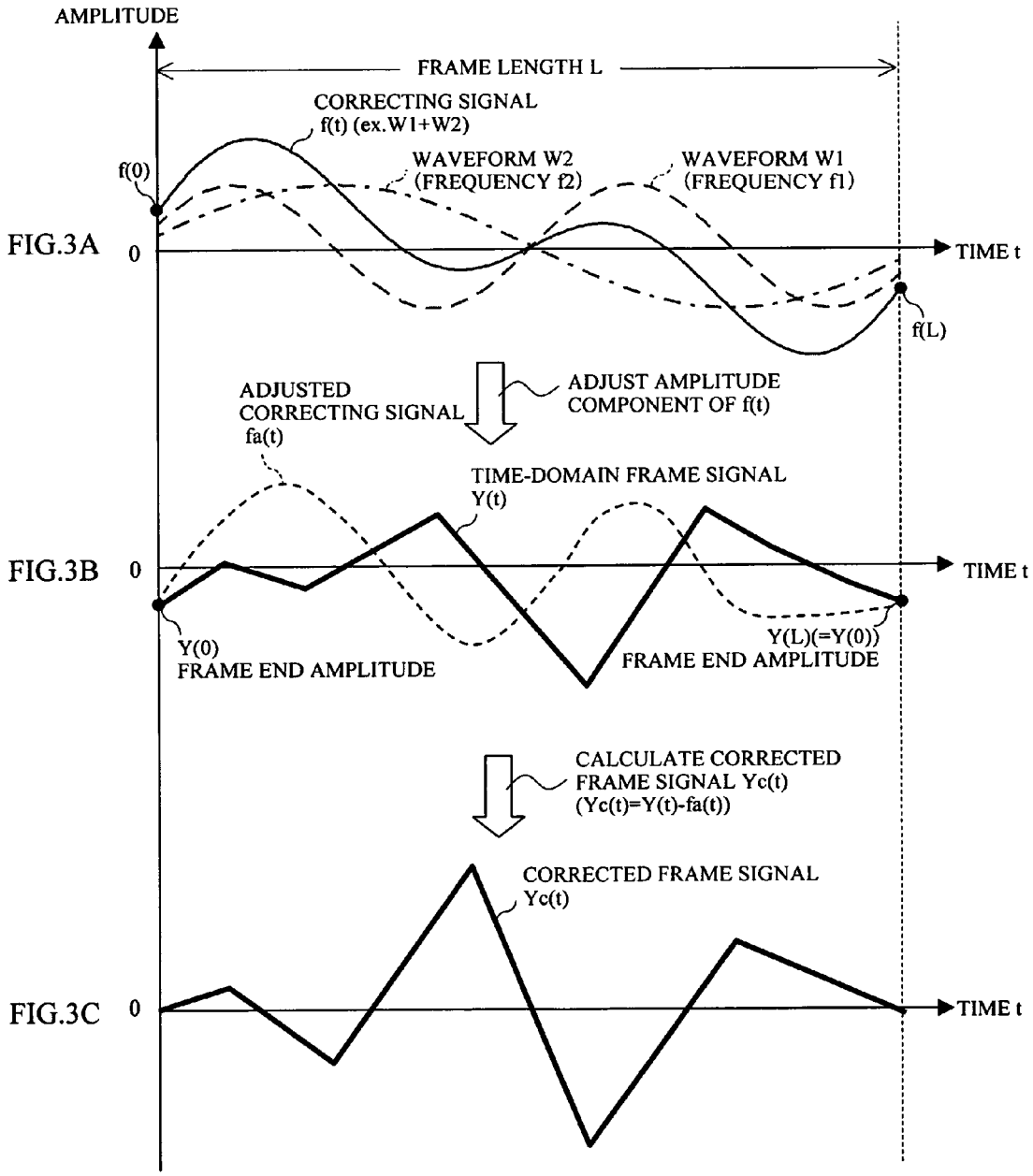
FIGS. 3A-3C are operation waveform diagrams showing a frame signal correcting example (1) of a distortion removing portion used for the embodiment [1] of the present invention.
Figure 4:
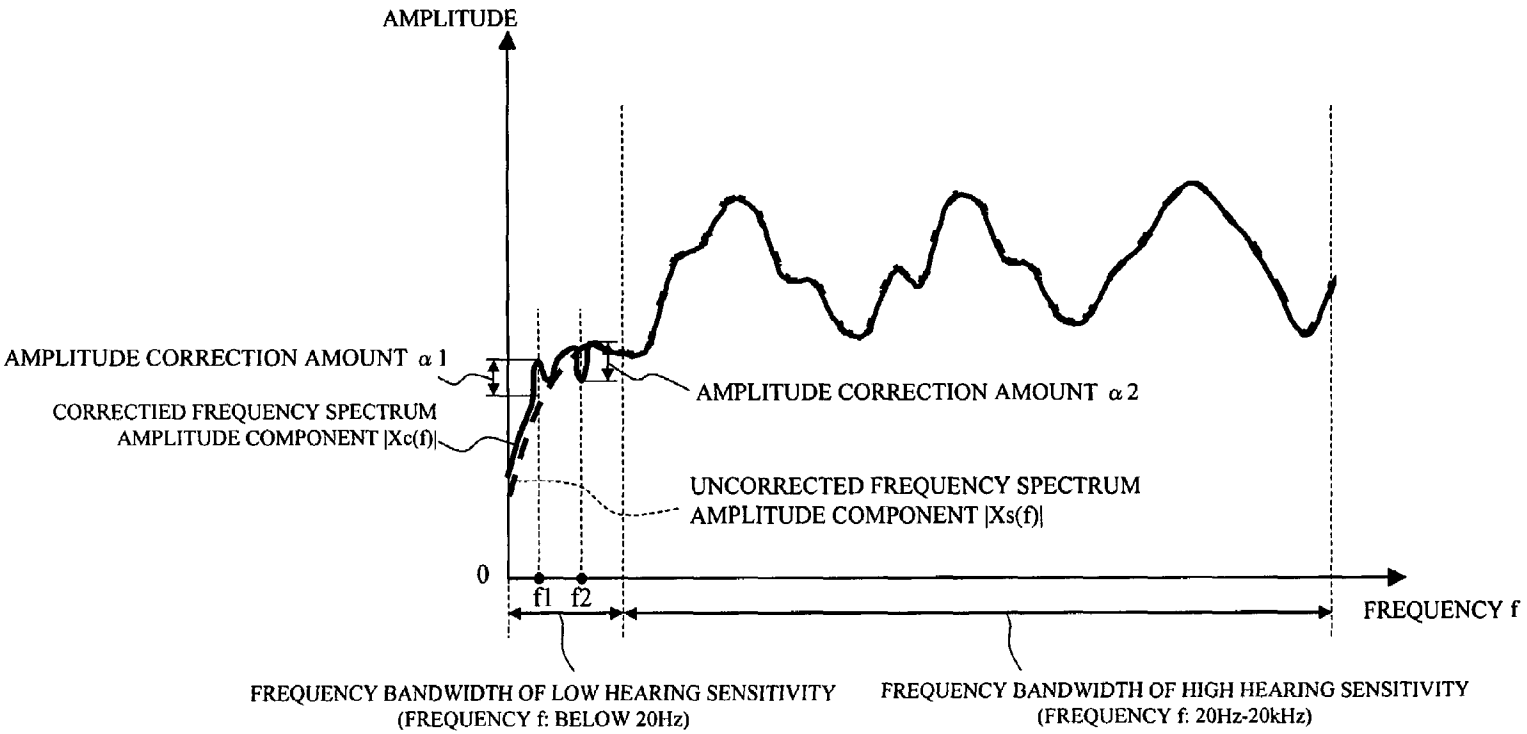
FIG. 4 is a graph diagram showing a frequency spectrum characteristic before and after a correction by a frame signal correcting example (1) of a distortion removing portion used for the embodiment [1] of the present invention.

FIG. 3A shows an embodiment of a correcting signal f(t) used by the distortion removing portion 50. This correcting signal f(t) has the same frame length L as the time-domain frame signal Y(t). For example, it is assumed that the correcting signal f(t) is indicated by a synthesized waveform of a waveform W1 of a frequency f1 and a waveform W2 of a frequency f2 as shown in FIG. 3A. While different amplitude values are respectively set in the amplitudes f(0) and f(L) of both ends of the correcting signal f(t) in this example, it is possible to set the same amplitude value.

Firstly, as shown in FIG. 3B, the distortion removing portion 50 adjusts the correcting signal f(t) so that the amplitudes f(0) and f(L) may be equal to the amplitudes Y(o) and Y(L) of both ends of the frame of the time domain frame signal Y(t) respectively (f(0)=Y(0), f(L)=Y(L)), and generates an adjusted correcting signal fa(t).

When the amplitudes f(0) and f(L) are set to amplitude values different from each other as mentioned above, the amplitude component of the correcting signal f(t) is offset by subtracting e.g. the amplitude Y(0) of one of the frame end of the time-domain frame signal Y(t) from the amplitude component of the correcting signal f(t) so that the amplitude f(0) may become equal to the amplitude Y(o). The amplitude component is further adjusted by using various known approximation methods or the like so as to be equal to the amplitude Y(L) of the other of the frame end of the time-domain frame signal Y(t).

The distortion removing portion 50 subtracts the adjusted correcting signal fa(t) from the time-domain frame signal Y(t) as shown in the following Eq.(8) to obtain the corrected frame signal Yc(t).

$$\cdot Yc(t) = Y(t) - fa(t) \qquad \text{Eq.(8)}$$

The amplitudes of both ends of the frame of the above-mentioned corrected frame signal Yc(t) become "0" as shown in FIG. 3C.

By the above-mentioned correction, only the amplitude component corresponding to the frequency component included in the adjusted correcting signal fa(t) (i.e. adjusted amplitude component corresponding to the frequencies f1 and f2 originally included in the correcting signal f(t)) is subtracted from the time-domain frame signal Y(t). Therefore, the corrected (corrected frame signal Yc(t)) frequency spectrum amplitude component |Xc(f)| shown by the solid line in FIG. 4 is obtained by increasing or decreasing only the amplitude component corresponding to the frequencies f1 and f2 by amplitude correction amounts α1 and α2 corresponding to the frequencies f1 and f2 respectively, from an uncorrected frequency spectrum amplitude component |Xs(f)| shown by the dotted line in FIG. 4.

I.2.C. Frame Signal Correcting Example (2): FIGS. 5A-5C, and 6

Figures 5A, 5B, 5C:
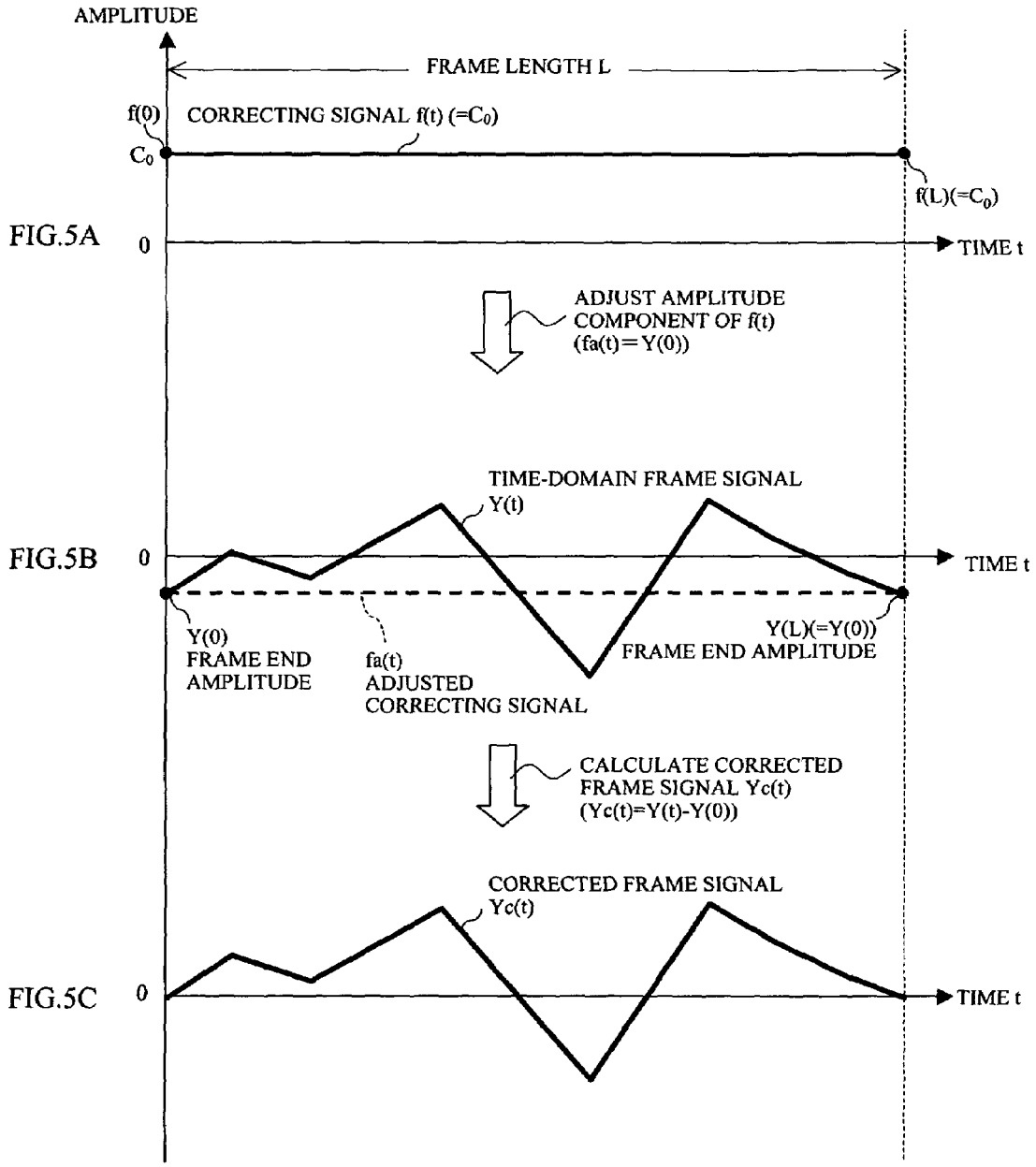
FIGS. 5A-5C are operation waveform diagrams showing a frame signal correcting example (2) of a distortion removing portion used for the embodiment [1] of the present invention.

The correcting signal f(t) shown in FIG. 5A is different from the above-mentioned frame signal correcting example (1) in that the amplitude component is set to include only the direct current component Co.

As shown in FIG. 5B, the distortion removing portion 50 adjusts the amplitude component of the correcting signal f(t) so that the amplitudes f(0) and f(L) of both ends of the correcting signal f(t) may be respectively equal to the amplitudes Y(0) and Y(L) of both ends of the time-domain frame signal Y(t). Namely, the adjusted correcting signal fa(t) is set as shown in the following Eq.(9).

$$\cdot fa(t) = Y(0) \qquad \text{Eq.(9)}$$

The distortion removing portion 50 corrects the time-domain frame signal Y(t) according to the above-mentioned Eq.(8), and obtains the corrected frame signal Yc(t) (=Y(t)−Y(0)).

As for the above-mentioned corrected frame signal Yc(t), the amplitude component of the corrected frame signal Yc(t) is offset by amplitude Y(0) as shown in FIG. 5C.

Also, as shown in FIG. 6, the corrected (corrected frame signal Yc(t)) frequency spectrum amplitude component |Xc(f)| (indicated by solid line) is the uncorrected frequency spectrum amplitude component |Xs(f)| (indicated by dotted line) in which only the direct current component (f=0) is changed by amplitude correction amount α.

It is to be noted that while the amplitudes of both ends of the correcting signal f(t) are adjusted so as to be equal to the amplitudes of both ends of the frame of the time-domain frame signal Y(t) in the above-mentioned frame signal correcting examples (1) and (2), it is possible to adjust the amplitudes so as to be equal to the amplitude Y(0) or Y(L) of one end of the frame of the time-domain frame signal Y(t). In this case, the above-mentioned description can be similarly applied.

The amplitude of one end of the corrected frame signal Yc(t) may not be "0", so that the corrected frame signal Yc(t)

and the adjoining corrected frame signal may be discontinuous. However, since the corrected frame signals assume discrete values (i.e. since signals have error) in the case of digital signals for such as voice, the signals are regarded as continuous.

II. Embodiment [2]: FIGS. 4, 6, 7, and 8

II. 1. Arrangement: FIG. 7

The signal processing apparatus 1 according to the embodiment [2] of the present invention shown in FIG. 7 is different from the above-mentioned embodiment [1] in that an amplitude component adjuster 120 which inputs the time-domain frame signal Y(t) and the processed amplitude component |Xs(f)|, and which outputs the corrected amplitude component |Xc(f)| in which the processed amplitude component |Xs(f)| is corrected in the frequency domain is inserted between the multiplier 30 and the time-domain converter 40 instead of the distortion removing portion 50, and in that the time-domain converter 40 inputs the corrected amplitude component |Xc(f)|.

II. 2. Operation Examples: FIGS. 4, 6, and 8

The operations of this embodiment will now be described. Only the operation example of the time-domain converter 40 and the amplitude component adjuster 120 will be described referring to FIG. 8 since other operations are common to those of the above-mentioned embodiment [1]. Also, FIGS. 4 and 6 used in the description of the above-mentioned embodiment [1] will be again used in the following description.

As shown in FIG. 8, the time-domain converter 40 having received the phase component arg X(f) of the frequency spectrum X(f) and the processed amplitude component |Xs(f)| performs the reverse orthogonal transform to the phase component arg X(f) and the processed amplitude component |Xs(f)| in the same way as the above-mentioned embodiment [1] to obtain the time-domain frame signal Y(t) (at step S10).

The time-domain converter 40 provides the time-domain frame signal Y(t) to the amplitude component adjuster 120 and waits for the reception of the corrected amplitude component |Xc(f)| from the amplitude component adjuster 120 (at step S11).

The amplitude component adjuster 120 having received the time-domain frame signal Y(t) from the time-domain converter 40 and the processed amplitude component |Xs(f)| from the multiplier 30 calculates the amplitude correction amount a for the processed amplitude component |Xs(f)| based on Parseval's theorem (at step S20). The Parseval's theorem comprises an equation indicating an equality between a signal power in the time domain and a spectrum power in the frequency domain as shown in the following Eq.(10), where the amplitude correction amount α is used as a difference when both are unequal.

$$\cdot \sum Y(t)^2 = \frac{1}{2\pi}\sum |Xs(f)|^2 \quad \text{(Parseval's theorem)} \qquad \text{Eq. (10)}$$

$$\Rightarrow \sum (Y(t) - Y(0))^2 = \frac{1}{2\pi}\left(\sum |Xs(f)|^2 + \alpha^2\right)$$

$$\Rightarrow \alpha = \sqrt{2\pi\sum (Y(t) - Y(0))^2 - \sum |Xs(f)|^2}$$

Namely, power $\alpha^2$ of the amplitude correction amount α in the above-mentioned Eq.(10) is a value which corrects a power of the spectrum in the frequency domain so that a signal (frame signal in which Y(0)="0") power (right side first term) in which the amplitude Y(0) of the frame end is removed from the time-domain frame signal Y(t) and a power (right side second term) of the processed amplitude component |Xs(f)| may be equal. Therefore, the amplitude correction amount a for the processed amplitude component |Xs(f)| obtained by calculating a square root can be used as the correction amount which substantially conforms the frame signal in which the amplitude Y(0) of the frame end is removed from the time-domain frame signal Y(t) to the corrected frame signal Yc(t) obtained by converting the corrected amplitude component |Xc(f)| into the time domain.

Also, when the amplitudes Y(0) and Y(L) of both ends of the frame of the time-domain frame signal Y(t) are equal to each other, the amplitude correction amount α becomes a correction amount substantially conforming the frame signal (i.e. Y(0)=Y(L)="0") in which the amplitudes Y(0) and Y(L) of both of the frame ends are removed from the time-domain frame signal Y(t) to the corrected frame signal Yc(t).

The amplitude component adjuster 120 obtains the amplitude of the direct current component of the corrected amplitude component |Xc(f)| by adding the amplitude correction amount a to the amplitude of the direct current component (f=0) of the processed amplitude component |Xs(f)| as shown in the following Eq.(11), obtains, as shown in the following Eq.(12), the amplitude component corresponding to a frequency (f≠0) other than the direct current component of the processed amplitude component |Xs(f)| as an amplitude component corresponding to the frequency other than the direct current component of the corrected amplitude component |Xc(f)| as it is (at step S21), and provides the corrected amplitude component |Xc(f)| to the time-domain converter 40 (at step S22).

$$\cdot |Xc(0)| = |Xs(0)| + \alpha \ (f=0) \qquad \text{Eq.(11)}$$

$$|Xc(f)| = |Xs(f)| \ (f \neq 0) \qquad \text{Eq.(12)}$$

Thus, the corrected amplitude component |Xc(f)| is the uncorrected frequency spectrum amplitude component |Xs(f)| in which only the direct current component is changed by amplitude correction amount a in the same way as FIG. 6.

Also, when the corrected amplitude component |Xc(f)| shown in FIG. 4 is desired to be obtained, the amplitude component adjuster 120 can add amplitude correction amounts α1 and α2 (α1+α2=α) which are the amplitude correction amount a divided respectively to both amplitudes corresponding to the frequencies f1 and f2 in the processed amplitude component |Xs(f)|, instead of adding the amplitude correction amount α only to the amplitude of the direct current component of the processed amplitude component |Xs(f)| as shown in the above-mentioned Eqs.(10) and (11).

The time-domain converter 40 having received the corrected amplitude component |Xc(f)| makes the frame signal obtained by performing the reverse orthogonal transform in the same way as the above-mentioned embodiment [1] the corrected frame signal Yc(t) (at step S12) to be provided to the frame synthesizing portion 60 (at step S13).

Thus, the corrected frame signal Yc(t) can be obtained similarly to the above-mentioned embodiment [1], and the output signal Out(t) in which the corrected frame signal Yc(t) is synthesized or added can be obtained.

III. Application Examples: FIGS. 9-12, and 13A-13D

Hereinafter, the application examples [1]-[4] of the present invention will be described referring to FIGS. 9-12, and 13A-13D. It is to be noted that while each apparatus in the following application examples is arranged to include the signal processing apparatus 1 (or part of the apparatus 1) of the above-mentioned embodiment [1], the apparatus may be substituted for the signal processing apparatus 1 of the above-mentioned embodiment [2].

III. 1. Application Example [1] (Noise Suppressing Apparatus): FIG. 9

A noise suppressing apparatus 2 shown in FIG. 9 performs a noise suppression as an example of processing at the multiplier 30. The noise suppressing apparatus 2 is arranged to include, in addition to the arrangement of the above-mentioned embodiment [1], a noise estimating portion 70 which estimates a noise spectrum |N(f)| from the amplitude component |X(f)| outputted form the frequency spectrum converter 20 in the signal processing apparatus 1, and a suppression coefficient calculator 80 which calculates a suppression coefficient G(f) based on the noise spectrum |N(f)| and the amplitude component |X(f)| to be provided to the multiplier 30.

In operation, the noise estimating portion 70 firstly estimates the noise spectrum |N(f)| from the amplitude component |X(f)| every time the amplitude component |X(f)| is received, and determines whether or not a voice is included in the amplitude component |X(f)|.

As a result, when it is determined that the voice is not included in the amplitude component |X(f)|, the noise estimating portion 70 updates the noise spectrum |N(f)| estimated according to the following Eq.(13), to be provided to the suppression coefficient calculator 80.

$$\cdot |N(f)|=A*|N(f)|+(1-A)*|X(f)| \text{ ("}A\text{" is a predetermined constant)} \quad \text{Eq.(13)}$$

On the other hand, when it is determined that the voice is included in the amplitude component |X(f)|, the noise estimating portion 70 does not update the noise spectrum |N(f)|.

The suppression coefficient calculator 80 having received the noise spectrum |N(f)| calculates an SN ratio (SNR(f)) from the noise spectrum |N(f)| and the amplitude component |X(f)| according to the following Eq.(14).

$$\cdot SNR(f)=|X(f)|/|N(f)| \quad \text{Eq.(14)}$$

The suppression coefficient calculator 80 further calculates the suppression coefficient G(f) according to the SNR(f) to be provided to the multiplier 30.

The multiplier 30 performs a noise suppression by multiplying the amplitude component |X(f)| of the frequency spectrum X(f) by the suppression coefficient G(f). As for the time-domain frame signal Y(t) converted into the time domain by the time-domain converter 40, the amplitudes of both of the frame ends deviate in some cases as mentioned above. However, a frame signal correction is performed by the distortion removing portion 50 shown in the above-mentioned embodiment [1], thereby enabling the deviation to be corrected. Alternatively in the above-mentioned embodiment [2], the amplitude component of the frequency spectrum is corrected by the amplitude component adjuster 120, thereby enabling the deviation to be corrected.

III.2 Application Example [2] (Echo Suppressing Apparatus): FIG. 10

An echo suppressing apparatus 3 shown in FIG. 10 performs an echo suppression as an example of processing at the multiplier 30. The echo suppressing apparatus 3 is arranged to include, in addition to the arrangement of the above-mentioned embodiment [1], a frame division/windowing portion **10*r* which divides a reference signal Ref(f) for the input signal In(t) into units of a predetermined length and performs a predetermined window function thereto, a frequency spectrum converter 20*r* which converts a windowed frame signal Wr(t) outputted from the frame division/windowing portion 10*r* into the frequency spectrum Xr (f) composed of the amplitude component |Xr(f)| and the phase component argXr (f), and a suppression coefficient calculator 80 which inputs the amplitude component |Xr(f)| outputted from the frequency spectrum converter 20*r* and the amplitude component |X(f)| outputted from the frequency spectrum converter 20 of the signal processing apparatus 1, and which calculates the suppression coefficient G(f) for suppressing an echo to be provided to the multiplier 30**.

In operation, the frame division/windowing portion **10*r* calculates the windowed frame signal Wr(t) in the same way as the frame division/windowing portion 10 of the signal processing apparatus 1, to be provided to the frequency spectrum converter 20*r*. The frequency spectrum converter 20*r* having received the signal Wr(t) converts the signal into the frequency spectrum Xr(f) in the same way as the frequency spectrum converter 20**.

The suppression coefficient calculator 80 having received the amplitude components |X(f)| and |Xr(f)| of the frequency spectrums X(f) and Xr(f) respectively compares both amplitude components, calculates the similarity (not shown), and calculates the suppression coefficient G(f) according to the similarity, to be provided to the multiplier 30.

The multiplier 30 multiplies the amplitude component |X(f)| by the suppression coefficient G(f) and performs the echo suppression. The time-domain converter 40 converts the amplitude component |Xs(f)| after the echo suppression into the time-domain frame signal Y(t).

As for the time-domain frame signal Y(t), the amplitudes of both of the frame ends deviate in some cases, like a case where the noise suppression is performed. Also in this case, the frame signal correction is performed by the distortion removing portion 50 shown in the above-mentioned embodiment [1], thereby enabling the deviation to be corrected. Alternatively in the above-mentioned embodiment [2], the amplitude component of frequency spectrum is corrected by the amplitude component adjuster 120, thereby enabling the deviation to be corrected.

III.3.Application Example [3] (Voice (or Acoustic) Decoding Apparatus): FIG. 11

A voice (or acoustic) decoding apparatus 4 shown in FIG. 11 is composed of the time-domain converter 40, the distortion removing portion 50, and the frame synthesizing portion 60 within the signal processing apparatus 1 of the above-mentioned embodiment [1]. This is different from the above-mentioned embodiment [1] in that an encoded signal X(f) inputted to the time-domain converter 40 is a frequency spectrum composed of the amplitude component |Xs(f)| and the phase component argX(f) to which predetermined encoding is provided.

The encoded signal X(f) is an encoded amplitude component |X(f)| of the frequency spectrum X(f) of the frame signal in which an encoding apparatus (not shown) on the transmission side performs the window function to the voice signal or the acoustic signal (namely, similar processing to the frame division/windowing portion 10, the frequency spectrum converter 20, and the multiplier 30 in the signal processing apparatus 1 is performed to the voice signal or acoustic signal).

The time-domain converter 40 of the voice (or acoustic) decoding apparatus 4 having received the encoded signal X(f) converts and decodes the amplitude component |Xs(f)|, to which the encoding is performed, into the time-domain frame signal Y(t). Thus, in the same way as the above-mentioned application examples [1] and [2], the amplitudes of both ends of the frame of the time-domain frame signal Y(t) deviate in some cases. Also in this case, the frame signal correction is performed by the distortion removing portion 50 shown in the above-mentioned embodiment [1], thereby enabling the deviation to be corrected. Alternatively in the above-mentioned embodiment [2], the amplitude component of the frequency spectrum is corrected by the amplitude component adjuster 120, thereby enabling the deviation to be corrected.

III. 4. Application Example [4] (Voice Synthesizer): FIGS. 12, and 13A-13D A voice synthesizer 5 shown in FIG. 12 performs processing of a phonemic piece in a frequency domain as an example of processing at the multiplier 30. The voice synthesizer 5 is arranged to include, in addition to the arrangement of the above-mentioned embodiment [1], a language processor 90 which analyzes an arbitrary character string CS to generate a plurality of phonetic character strings PS, a rhythm generator 100 which generates lengths PL and pitches PP from the phonetic character strings PS, a voice dictionary DCT which records all phonetic character strings PS estimated and phonemic pieces Ph(t) corresponding thereto, a controller 110 which extracts phonemic pieces Ph(t) corresponding to the phonetic character strings PS generated by the language processor 90 from the voice dictionary DCT, provides the phonemic pieces to the signal processing apparatus 1 as an input signal In(t), determines a connection order of the phonemic pieces Ph(t) from the lengths PL and the pitches PL generated by the rhythm generator 100, and generates connection order information INFO indicating the connection order, and an amplitude correction coefficient calculator 150 which calculates an amplitude correction coefficient H(f) for smoothly connecting the amplitude component |X(f)| of the frequency spectrums X(f) of the phonemic pieces Ph(t) outputted from the frequency spectrum converter 20 based on the connection order information INFO, to be provided to the multiplier 30.

In operation, the language processor 90 firstly generates a plurality of phonetic character strings PS from the inputted character strings CS, to be provided to the controller 110. As shown in FIG. 13A, for example, when the character string CS is "KONNICHIWA", the language processor 90, as shown in FIG. 13B, generates phonetic character strings PS1 "KON", PS2 "NICHI", and PS3 "WA" respectively.

The rhythm generator 100 generates lengths PL1-PL3 and pitches PP1-PP3 (not shown) from the phonetic character strings PS1-PS3, to be provided to the controller 110.

The controller 110 having received the phonetic character strings PS1-PS3, as shown in FIG. 13C, extracts phonemic pieces Ph1(*t*)-Ph3(*t*) respectively corresponding to the phonetic character strings PS1-PS3 from the voice dictionary DCT. The phonemic pieces Ph1(*t*)-Ph3(*t*) are obtained by cutting parts of the phonemic pieces corresponding to "KONDO", "31NICHI", and "WANAGE" recorded in the voice dictionary DCT.

Since the phonemic pieces Ph1(*t*)-Ph3(*t*) are obtained from different phonemic pieces respectively, their amplitude components are different and discontinuous in some cases. Therefore, it is necessary to perform processing so that the amplitude components of the phonetic pieces Ph1(*t*)-Ph3(*t*) become continuous at their boundaries.

In this application example, this processing is performed by an amplitude correction coefficient calculator 150 which will be described later, and the multiplier 30 having received the amplitude correction coefficient H(f) from the amplitude correction coefficient calculator 150.

Also, the amplitude correction coefficient calculator 150 has to preliminarily recognize a connection order of the phonemic pieces Ph1(*t*)-Ph3(*t*) upon processing.

Therefore, before the processing, the controller 110 determines the connection order ("KON"→"NICHI"→"WA") of the phonetic pieces Ph1(*t*)-Ph3(*t*) as shown in FIG. 13D, from the lengths PL1-PL3 and pitches PP1-PP3, and provides the connection order information INFO indicating the order to the amplitude correction coefficient calculator 150.

The amplitude correction coefficient calculator 150 calculates the amplitude correction coefficient H(f) for mutually and smoothly connecting the amplitude component |X(f)| based on the connection order information INFO every time the amplitude component |X(f)| of the frequency spectrums corresponding to the phonemic pieces Ph1(*t*)-Ph3(*t*) are received, to be provided to the multiplier 30.

The multiplier 30 multiplies the amplitude component |X(f)| by the amplitude correction coefficient H(f) to perform processing thereto. The time-domain converter 40 converts the processed amplitude component |Xs(f)| into the time-domain frame signal Y(t).

The phonemic pieces Ph1(*t*)-Ph3(*t*) are once smoothly connected by the processing at the multiplier 30. However, by the conversion into the time domain at the time-domain converter 40, the amplitudes of both of the frame ends of the time-domain frame signal Y(t) again deviate in some cases in the same way as the above-mentioned application examples [1]-[3]. Also in this case, the correction can be performed by the frame signal correction (or correction to the amplitude component of the frequency spectrum by the amplitude component adjuster 120) at the distortion removing portion 50 shown in the above-mentioned embodiment [1] (or embodiment [2]).

It is to be noted that the present invention is not limited by the above-mentioned embodiments, and it is obvious that various modifications may be made by one skilled in the art based on the recitation of the claims.

What is claimed is:

1. A signal processing apparatus comprising:

a processor and a memory storing program code, the processor executing the program code to implement:

a first means that converts a first frame signal of a predetermined length to which a predetermined window function is performed into a frequency spectrum signal;

a second means that performs a noise suppressing to the frequency spectrum signal to generate a noise suppressed frequency spectrum signal;

a third means that converts the noise suppressed frequency spectrum signal into a second frame signal of a time domain by adjusting a predetermined correcting signal having a same frame length as the second frame signal so that amplitudes of both ends of the correcting signal substantially become equal to amplitudes of both or one of the frame ends of the second frame signal, a fourth means that provides a corrected frame signal before frame synthesizing by subtracting the adjusted correcting signal from the second frame signal, so that amplitudes of both or one of the frame ends of the second frame signal are made zero, wherein the correcting signal is made by adding time domain signals each having a different frequency component, in which a frequency component of a waveform function of the added correcting signal corresponds to a low frequency component to be corrected in the second frame signal.

2. The signal processing apparatus as claimed in claim 1, wherein the predetermined processing of the first means estimates a noise spectrum from an amplitude component of the frequency spectrum of the first frame signal, and suppresses noise within an amplitude component of the frequency spectrum of the first frame signal based on the noise spectrum.

3. The signal processing apparatus as claimed in claim 1, wherein the predetermined processing of the first means comprises calculating a suppression coefficient for suppressing an echo by comparing an amplitude component of a frequency spectrum of a reference frame signal to which the predetermined window function is performed with the amplitude component of the frequency spectrum of the first frame signal, and multiplying the amplitude component of the frequency spectrum of the first frame signal by the suppression coefficient.

4. The signal processing apparatus as claimed in claim 1, wherein the first frame signal comprises a voice signal or an acoustic signal to which the predetermined window function is performed, the predetermined processing comprises encoding for the frequency spectrum of the first frame signal, and the first means includes a means decoding by converting the encoded frequency spectrum into the time domain to generate the second frame signal.

5. The signal processing apparatus as claimed in claim 1, wherein the first frame signal comprises a phonemic piece corresponding to one phonetic character string of a plurality of phonetic character strings generated by analyzing an arbitrary character string, the phonemic piece being extracted from a voice dictionary in which all phonetic character strings estimated and phonetic pieces corresponding thereto are recorded and to which the predetermined window function is performed, wherein a frame signal adjacent to the first frame signal with a partial overlap with each other comprises a phonemic piece corresponding to another phonetic character string of the phonetic character strings, the phonemic piece being extracted from the voice dictionary and to which the predetermined window function is performed, and the predetermined processing comprises determining a connection order of the phonemic pieces from a length and a pitch generated from the phonetic character strings, calculating an amplitude correction coefficient for mutually connecting the frequency spectrums of the phonetic pieces smoothly based on the connection order, and multiplying the amplitude component of the frequency spectrum of each phonemic piece by each amplitude correction coefficient.

6. The signal processing apparatus as claimed in claim 1, further comprising a means for adding overlap portions of a frame signal obtained by correcting a present frame signal, and a frame signal obtained by correcting a frame signal immediately before the present frame signal, where the frame signal and the adjacent frame signal partially overlap with each other.

7. A signal processing apparatus comprising:

a processor and a memory storing program code, the processor executing the program code to implement:

a first means that converts a first frame signal of a predetermined length to which a predetermined window function is performed into a frequency spectrum signal;

a second means that performs a noise suppressing to the frequency spectrum signal to generate a noise suppressed frequency spectrum signal;

a third means that converts the noise suppressed frequency spectrum signal into a second frame signal of a time domain; and a fourth means that calculates an amplitude correction amount given by a square root of a difference between a power of a signal obtained by removing amplitudes of both or one of the frame ends of the second frame signal from the second frame signal and by a power of the noise suppressed frequency spectrum signal, and further calculates a corrected amplitude component for a low frequency component or a direct current component of the noise suppressed frequency spectrum signal by adding the amplitude correction amount to the low frequency component or the direct current component of the noise suppressed frequency spectrum signal, and converts the corrected amplitude component into a corrected frame signal of a time domain before frame synthesizing, wherein the corrected amplitude component is utilized to generate a correcting signal is made by adding time domain signals each having a different frequency component, in which a frequency component of a waveform function of the added correcting signal corresponds to a low frequency component to be corrected in the second frame signal.

8. The signal processing apparatus as claimed in claim 7, wherein the predetermined processing of the first means estimates a noise spectrum from an amplitude component of the frequency spectrum of the first frame signal, and suppresses noise within an amplitude component of the frequency spectrum of the first frame signal based on the noise spectrum.

9. The signal processing apparatus as claimed in claim 7, wherein the predetermined processing of the first means comprises calculating a suppression coefficient for suppressing an echo by comparing an amplitude component of a frequency spectrum of a reference frame signal to which the predetermined window function is performed with the amplitude component of the frequency spectrum of the first frame signal, and multiplying the amplitude component of the frequency spectrum of the first frame signal by the suppression coefficient.

10. The signal processing apparatus as claimed in claim 7, wherein the first frame signal comprises a voice signal or an acoustic signal to which the predetermined window function is performed, the predetermined processing comprises encoding for the frequency spectrum of the first frame signal, and the first means includes a means decoding by converting the encoded frequency spectrum into the time domain to generate the second frame signal.

11. The signal processing apparatus as claimed in claim 7, wherein the first frame signal comprises a phonemic piece corresponding to one phonetic character string of a plurality of phonetic character strings generated by analyzing an arbitrary character string, the phonemic piece being extracted from a voice dictionary in which all phonetic character strings estimated and phonetic pieces corresponding thereto are recorded and to which the predetermined window function is performed, wherein a frame signal adjacent to the first frame signal with a partial overlap with each other comprises a phonemic piece corresponding to another phonetic character string of the phonetic character strings, the phonemic piece being extracted from the voice dictionary and to which the predetermined window function is performed, and the predetermined processing comprises determining a connection order of the phonemic pieces from a length and a pitch generated from the phonetic character strings, calculating an amplitude correction coefficient for mutually connecting the frequency spectrums of the phonetic pieces smoothly based on the connection order, and multiplying the amplitude component of the frequency spectrum of each phonemic piece by each amplitude correction coefficient.

12. The signal processing apparatus as claimed in claim 7, further comprising a means adding overlap portions of a frame signal obtained by correcting a present frame signal, and a frame signal obtained by correcting a frame signal immediately before the present frame signal, where the frame signal and the adjacent frame signal partially overlap with each other.

* * * * *